US010928745B2

(12) United States Patent
Miura et al.

(10) Patent No.: US 10,928,745 B2
(45) Date of Patent: Feb. 23, 2021

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Satoshi Miura, Kanagawa (JP); Yoshimasa Fujihara, Kanagawa (JP); Shintaro Anno, Kanagawa (JP); Daisuke Noguchi, Kanagawa (JP); Takuro Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/727,158

(22) Filed: Dec. 26, 2019

(65) Prior Publication Data

US 2020/0301300 A1 Sep. 24, 2020

(30) Foreign Application Priority Data

Mar. 22, 2019 (JP) ..... JP2019-055422
May 22, 2019 (JP) ..... JP2019-095743

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 21/18*** | (2006.01) |
| ***G03G 15/08*** | (2006.01) |

(52) U.S. Cl.
CPC ..... *G03G 9/09725* (2013.01); *G03G 9/0819* (2013.01); *G03G 9/08755* (2013.01); *G03G 15/0865* (2013.01); *G03G 21/1814* (2013.01)

(58) Field of Classification Search
CPC ..... G03G 9/08755; G03G 9/09725
USPC ..... 430/108.7, 109.4
See application file for complete search history.

(56) References Cited

U.S. PATENT DOCUMENTS

2017/0315463 A1* 11/2017 Onozaki ..... G03G 9/08755

FOREIGN PATENT DOCUMENTS

JP 2014-164064 A 9/2014

* cited by examiner

*Primary Examiner* — Mark A Chapman
(74) *Attorney, Agent, or Firm* — Sughrue Mion, PLLC

(57) ABSTRACT

An electrostatic charge image developing toner includes: toner particles including an amorphous resin and a crystalline polyester resin including a polycondensate of a linear dicarboxylic acid and a linear dialcohol having 2 to 12 carbon atoms; and an external additive including silica particles having a BET specific surface area of 100 $m^2/g$ or more. The electrostatic charge image developing toner satisfies the expression: $0.05 \leq \Delta H2/\Delta H1 \leq 0.95$, wherein $\Delta H1$ (mW/g) is an endothermic energy amount based on an endothermic peak derived from the crystalline polyester resin in a first temperature increase process in differential scanning calorimetry according to ASTM D3418-8 (2008), and $\Delta H2$ (mW/g) is an endothermic energy amount based on an endothermic peak derived from the crystalline polyester resin in a second temperature increase process in differential scanning calorimetry according to ASTM D3418-8 (2008).

20 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2019-055422 filed Mar. 22, 2019 and Japanese Patent Application No. 2019-095743 filed May 22, 2019.

BACKGROUND

(i) Technical Field

The present disclosure relates to an electrostatic charge image developing toner, an electrostatic charge image developer, a toner cartridge, a process cartridge, an image forming apparatus, and an image forming method.

(ii) Related Art

JP-A-2014-164064 discloses an electrostatic charge image developing toner that includes a binder resin including a block copolymer having a crystalline polyester block and an amorphous polyester block and has a Q2/Q1 ratio of 1.0 to 1.2, in which Q1 is a melting point peak area based on the crystalline polyester block, which is obtained when the toner is measured with a differential scanning calorimeter, and Q2 is a melting point peak area based on the crystalline polyester block, which is obtained when the toner is measured with a differential scanning calorimeter after the toner is stored at 50° C. for one week.

SUMMARY

Aspects of non-limiting embodiments of the present disclosure relate to providing an electrostatic charge image developing toner including: toner particles including an amorphous resin and a crystalline polyester resin including a polycondensate of a linear dicarboxylic acid and a linear dialcohol having 2 to 12 carbon atoms; and an external additive, in which the external additive is less likely to separate from the toner particles than in a case where the external additive includes only silica particles with a BET specific surface area of less than 100 $m^2/g$ or a case where the expression $0.05>\Delta H2/\Delta H1$ or $\Delta H2/\Delta H1>0.95$ is satisfied, wherein $\Delta H1$ (mW/g) is an endothermic energy amount based on an endothermic peak derived from the crystalline polyester resin in a first temperature increase process in differential scanning calorimetry according to ASTM D3418-8, and $\Delta H2$ (mW/g) is an endothermic energy amount based on an endothermic peak derived from the crystalline polyester resin in a second temperature increase process in differential scanning calorimetry according to ASTM D3418-8.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic charge image developing toner including: toner particles including an amorphous resin and a crystalline polyester resin including a polycondensate of a linear dicarboxylic acid and a linear dialcohol having 2 to 12 carbon atoms: and an external additive including silica particles having a BET specific surface area of 100 $m^2/g$ or more. The electrostatic charge image developing toner satisfies the expression: $0.05\leq\Delta H2/\Delta H1\leq0.95$, wherein $\Delta H1$ (mW/g) is an endothermic energy amount based on an endothermic peak derived from the crystalline polyester resin in a first temperature increase process in differential scanning calorimetry according to ASTM D3418-8 (2008), and $\Delta H2$ (mW/g) is an endothermic energy amount based on an endothermic peak derived from the crystalline polyester resin in a second temperature increase process in differential scanning calorimetry according to ASTM D3418-8 (2008).

BRIEF DESCRIPTION OF THE DRAWINGS

Exemplary embodiments of the present invention will be described in detail based on the following figures, wherein.

DETAILED DESCRIPTION

Figure 1:
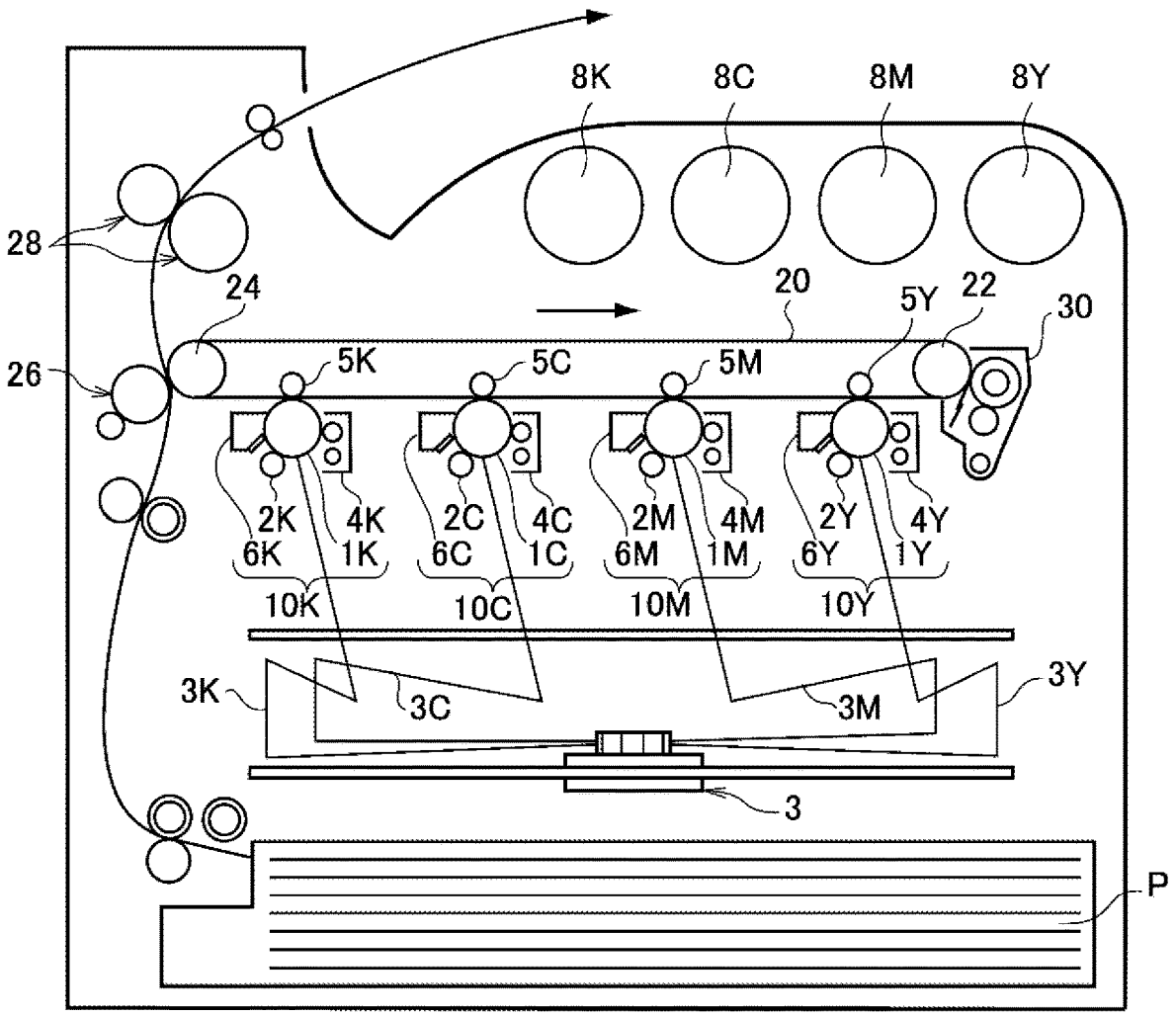
FIG. 1 is a schematic configuration diagram illustrating an example of an image forming apparatus according to the exemplary embodiment.

Hereinafter, the exemplary embodiment of the disclosure will be described. These descriptions and examples illustrate the exemplary embodiments and do not limit the scope of the exemplary embodiment.

In the present specification, the numerical ranges specified using "to" include the numerical values before and after "to" as the minimum and maximum values, respectively.

Among numerical ranges sequentially listed in the specification, the upper or lower limit of one numerical range may be replaced with the upper or lower limit of any other numerical range. The upper or lower limit of any numerical range specified in the specification may also be replaced with any value shown in Examples.

As used herein, the term "step" is intended to include not only an independent step but also any undistinguishable step that can achieve a desired purpose.

It will be understood that when described with reference to the drawings, the embodiments may have any other features not illustrated in the drawings. It should also be noted that each drawing schematically shows the dimensions of each component and shows a non-limiting example of the relative dimensional relationship between components.

In the present disclosure, each component may include plural corresponding substances. When plural substances correspond to a certain component of a composition described in the specification, the content of the component in the composition may mean the total content of the substances in the composition, unless otherwise specified.

In the present disclosure, each component may include plural types of corresponding particles. When plural types of particles correspond to a certain component of a composition, the particle size of the component may mean the particle size of a mixture of the plural types of particles in the composition, unless otherwise specified.

As used herein, the term "electrostatic charge image developing toner" is also simply referred to as "toner", and "electrostatic charge image developer" is also simply referred to as "developer".

Electrostatic Charge Image Developing Toner

The toner according to the exemplary embodiment includes: toner particles including an amorphous resin and a crystalline polyester resin including a polycondensate of a linear dicarboxylic acid and a linear dialcohol having 2 to 12 carbon atoms (hereinafter also referred to as "specific crystalline polyester resin"); and an external additive including silica particles having a BET specific surface area of 100 $m^2/g$ or more (hereinafter also referred to as "specific silica particles"). The toner satisfies the expression: $0.05 \leq \Delta H2/\Delta H1 \leq 0.95$, wherein $\Delta H1$ (mW/g) is an endothermic energy amount based on an endothermic peak derived from the crystalline polyester resin in a first temperature increase process in differential scanning calorimetry according to ASTM D3418-8 (2008), and $\Delta H2$ (mW/g) is an endothermic energy amount based on an endothermic peak derived from the crystalline polyester resin in a second temperature increase process in differential scanning calorimetry according to ASTM D3418-8 (2008).

Hereinafter, $\Delta H2/\Delta H1$ is also referred to as "$\Delta H2/\Delta H1$ value".

In the toner according to the exemplary embodiment, the external additive is prevented from separating from the toner particles in contrast to the case where the external additive includes only silica particles having a BET specific surface area of less than 100 $m^2/g$ or the case where the $\Delta H2/\Delta H1$ value is less than 0.05 or more than 0.95. Although the exact reason is not clear, a possible reason may be as follows.

When silica particles are used as an external additive, a non-electrostatic adhesion force seems to be dominant for adhesion of the silica particles to the surface of toner particles, although the toner and silica particles seem to repel each other electrostatically. Therefore, electrostatically repelling silica particles may separate from the surface of toner particles, for example, when they are stirred in a cartridge.

In the exemplary embodiment, however, specific silica particles are used, the toner particles used include an amorphous resin and a specific crystalline polyester resin, and the $\Delta H2/\Delta H1$ value is 0.05 to 0.95.

Water can be more easily adsorbed to the specific silica particles than to silica particles having a BET specific surface area of less than 100 $m^2/g$, so that a suitable amount of water can be retained on the surface. In addition, the amorphous resin and the specific crystalline polyester resin are soluble at a suitable level in each other in the toner particles including these resins and having the $\Delta H2/\Delta H1$ value in the above range. Therefore, it is suggested that electrostatic repulsion between the toner particles and the specific silica particles can be reduced so that the external additive including the specific silica particles can be prevented from separating, when the specific silica particles having surfaces on which a suitable amount of water is retained are externally attached to the surfaces of the toner particles in which the amorphous resin and the specific crystalline polyester resin are soluble at a suitable level in each other.

In this regard, when the toner is measured, $\Delta H1$ and $\Delta H2$ may be obtained as described below in accordance with ASTM D3418-8 (2008). The term "crystalline resin" refers to a resin having a clear endothermic peak rather than stepwise changes in endothermic energy amount in differential scanning calorimetry (DSC) according to ASTM D3418-8 (2008).

First, 10 mg of toner to be measured is placed in a differential scanning calorimeter (manufactured by Shimadzu Corporation: DSC-60A) equipped with an automatic tangential processing system, and the toner is heated from room temperature (25° C.) to 150° C. at a rate of temperature increase of 10° C./min and held at 150° C. for 5 minutes to obtain a temperature increase spectrum (DSC curve) in the first temperature increase process.

Subsequently, the temperature is lowered to 0° C. at a rate of temperature decrease of −10° C./min using liquid nitrogen, and held at 0° C. for 5 minutes.

Thereafter, the toner is heated to 150° C. at a rate of temperature increase of 10° C./min to obtain a temperature increase spectrum (DSC curve) in the second temperature increase process.

Endothermic peaks derived from the specific crystalline polyester resin are identified from the two temperature increase spectra (DSC curves) obtained. Specifically, the spectra are compared with a DSC chart of the crystalline resin alone measured in advance, and endothermic peaks at or near a certain temperature are determined to be endothermic peaks derived from the crystalline resin. In this case, the endothermic peaks may have a half width of 15° C. or less.

In addition, using each temperature increase spectrum, the area of the endothermic peak derived from the specific crystalline polyester resin is calculated as the amount of endothermic energy. The area of the endothermic peak may be the area of a region surrounded by the base line and the endothermic peak derived from the specific crystalline polyester resin in accordance with ASTM D3418-8 (2008). Then, the amount of endothermic energy per weight of the sample is calculated from the area of each endothermic peak when the amount of endothermic energy derived from the specific crystalline polyester resin is calculated.

First Embodiment

Among the exemplary embodiments, in an embodiment in which the $\Delta H2/\Delta H1$ value is greater than 0.35 and equal to or less than 0.95 (hereinafter, also referred to as "first embodiment"), the detachment of the external additive from the toner particles is prevented, so that the detached external additive is prevented from being attached to a wall surface of the toner cartridge.

In recent years, from the viewpoint of cost reduction and toner discharge properties, a rotary toner cartridge that transports toner by rotating the toner cartridge itself without having a transport member is used. In the rotary toner cartridge without having a transport member, when the external additive is detached from the toner particles, the detached external additive tends to be attached to the wall surface of the toner cartridge. In particular, when the environment fluctuates from high temperature and high humidity (for example, temperature of 28° C., humidity of 85%) to low temperature and low humidity (for example, temperature of 22° C., humidity of 15%), the wall surface in the cartridge is dewed and external additive attached to the wall surface may be easily fixed. Furthermore, in a case of using a cartridge in which the internal toner is visually recognized using a transparent or translucent container from the viewpoint of preventing misuse or the like, if the external additive attached to the wall surface is fixed, it may lead to misuse.

On the other hand, when the toner according to the first embodiment is used, the detachment of the external additive from the toner particles is further prevented, so that the detached external additive is also prevented from being attached to the wall surface of the toner cartridge.

In the first embodiment, the reason for further preventing the detachment of the external additive from the toner particles is not clear, but is estimated as follows.

As described above, the specific silica particles used in the first embodiment easily adsorb the moisture, and the moderate moisture is retained on the surface. In addition, in the toner particles containing the amorphous resin and the specific crystalline polyester resin and having the $\Delta H2/\Delta H1$ value which is greater than 0.35 and equal to or less than 0.95, the amorphous resin and the specific crystalline polyester resin on the surface of the toner particles are partially compatible with each other. Due to this appropriate compatibility, the components of the specific crystalline polyester resin are dispersed over the entire surface of the toner particles, so that a path for electric charges (hereinafter, also referred to as "conductive path") is easily formed on the surface of the toner particles. It is therefore suggested that a suitable amount of water retained on the surface of the specific silica particles and the conductive path formed on the surface of the toner particles may further reduce the electrostatic repulsion between the toner particles and the silica particles, so that the separation may be further less likely to occur.

Second Embodiment

Among the exemplary embodiments, in an embodiment in which the $\Delta H2/\Delta H1$ value is 0.05 to 0.35 (hereinafter, also referred to as "second embodiment"), uneven distribution of the external additive attached to the surface of toner particles is prevented, and the detachment of the external additive from the toner particles is prevented, so that a decrease in transferability in an environment of high temperature and high humidity (for example, temperature of 28° C., humidity of 85%) is prevented.

In recent years, it has been required to form an image using toners of various colors on various recording media. In particular, in a case where multiple color toner images are transferred onto a recording medium with large surface irregularities such as embossed paper in a high temperature and high humidity environment, if the toner with unevenly distributed external additives is used, the transferability is reduced by an increase of the toner attachment due to the surface exposure of the toner particles, and image defects (white spot) due to transfer defects may occur. On the other hand, when the toner according to the second embodiment is used, the uneven distribution of the external additives attached to the surface of the toner particles is prevented, and the detachment of the external additive from the toner particles is prevented, and thereby surface exposure of the toner particles is prevented, and transferability deterioration due to the surface exposure of the toner particles is prevented even in a high temperature and high humidity environment.

In the second embodiment, the reason why the uneven distribution of the external additives attached to the surface of the toner particles is prevented, and the detachment of the external additive from the toner particles is prevented is not clear, but is estimated as follows.

It is suggested that in the toner particles containing the amorphous resin and the specific crystalline polyester resin and having the $\Delta H2/\Delta H1$ value of 0.05 to 0.35, incompatible portions of the specific crystalline polyester resin on the surface of the toner particles are dispersed in a nearly uniform state. Here, since the incompatible portion of the specific crystalline polyester resin has a low resistance as compared with the amorphous resin, the electrostatic adhesive force is weak due to charge leakage and the external additive is difficult to be attached thereto. Therefore, when the incompatible portions of the specific crystalline polyester resin are unevenly distributed on the surface of the toner particles, the surface of the toner particles is easily exposed. On the other hand, in the second embodiment, as described above, the incompatible portion of the specific crystalline polyester resin on the surface of the toner particles is dispersed in a nearly uniform state, and thus it is estimated that the uneven distribution of the external additive attached to the surface of toner particles is prevented.

In addition, the specific silica particles used in the second embodiment are easy to adsorb moisture as described above, and moderate moisture is retained on the surface, and thus it is estimated that the electrostatic repulsion between the toner particles and the silica particles is prevented, and the external additive is less likely to be detached from the surface of the toner particles.

From the above, in the second embodiment, it is concluded that the external additives attached to the surface of the toner particles are prevented from being unevenly distributed and the external additives are prevented from separating from the toner particles.

Hereinafter, the toner according to the exemplary embodiment will be described in detail.

The toner according to the exemplary embodiment includes toner particles and an external additive.

Toner Particles

The toner particles include a binder resin and if necessary, a coloring agent, a release agent, and other additives.

Binder Resin

The toner particles include, as a binder resin, at least an amorphous resin and a crystalline polyester resin (that is, a specific crystalline polyester resin) formed of a polycondensate of linear dicarboxylic acid and linear dialcohol having 2 to 12 carbon atoms.

In addition, "crystallinity" of resin means to have a clear endothermic peak instead of a stepwise endothermic change in differential scanning calorimetry (DSC), and specifically means that the half-width of the endothermic peak at the time of being measured at the rate of temperature increase of 10 (° C./min) is within 15° C.

On the other hand, "amorphous" of the resin means that the half-width exceeds 15° C., a stepwise endothermic change is exhibited, or that no clear endothermic peak is observed.

The binder resin may contain other resins if necessary. However, the total content of the amorphous resin and the specific crystalline polyester resin is preferably 80% by weight or more, more preferably 90% by weight or more, and still more preferably 95% by weight or more based on the entire resins contained in the toner particles.

The content of the binder resin is, for example, preferably from 40% by weight to 95% by weight, is more preferably from 50% by weight to 90% by weight, and is still more preferably from 60% by weight to 85% by weight, with respect to the entire toner particles.

Amorphous Resin

Examples of the amorphous resin include vinyl resins formed of homopolymer of monomers such as styrenes (for example, styrene, para-chlorostyrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the amorphous resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These amorphous resins may be used singly or in combination of two or more types thereof.

As the amorphous resin, the polyester resin is preferably used.

Examples of the polyester resin include a well-known amorphous polyester resin.

Amorphous Polyester Resin

Examples of amorphous polyester resins include condensation polymers of polyvalent carboxylic acids and polyhydric alcohols. The amorphous polyester resin to be used may be a commercially available product or a product obtained by synthesis.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more types thereof.

Examples of the polyhydric alcohol include aliphatic diol (for example, ethylene glycol, diethylene glycol, triethylene glycol, propylene glycol, butanediol, pentanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyhydric alcohol.

As the polyhydric alcohol, a tri- or higher-valent polyhydric alcohol employing a crosslinked structure or a branched structure may be used in combination together with diol. Examples of the tri- or higher-valent polyhydric alcohol include glycerin, trimethylolpropane, and pentaerythritol.

The polyhydric alcohol may be used singly or in combination of two or more types thereof.

The glass-transition temperature (Tg) of the amorphous polyester resin is preferably in a range of 50° C. to 80° C., and further preferably in a range of 50° C. to 65° C.

The glass-transition temperature is obtained from a DSC curve obtained by differential scanning calorimetry (DSC). More specifically, the glass-transition temperature is obtained from "extrapolated glass transition onset temperature" described in the method of obtaining a glass-transition temperature in JIS K 7121-1987 "testing methods for transition temperatures of plastics".

The weight average molecular weight (Mw) of the amorphous polyester resin is preferably in a range of 5,000 to 1,000,000, and is more preferably in a range of 7,000 to 500,000, and is still more preferably in a range of 9,000 to 100,000.

The number average molecular weight (Mn) of the amorphous polyester resin is preferably in a range of 2,000) to 100,000.

The molecular weight distribution Mw/Mn of the amorphous polyester resin is preferably in a range of 1.5 to 100, and is further preferably in a range of 2 to 60.

The weight average molecular weight and the number average molecular weight are measured by gel permeation chromatography (GPC). The molecular weight measurement by GPC is performed using GPC & HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to produce the amorphous polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Specific Crystalline Polyester Resin

The specific crystalline polyester resin is formed of a polycondensate of linear dicarboxylic acid and linear dialcohol having 2 to 12 carbon atoms. That is, the specific crystalline polyester resin is formed of a polycondensate containing at least a structural unit derived from linear dicarboxylic acid and a structural unit derived from linear dialcohol having 2 to 12 carbon atoms.

The specific crystalline polyester resin may include at least linear dicarboxylic acid and linear dialcohol having 2 to 12 carbon atoms as monomer components, and may include other monomer components if necessary. Note that, the total content of the linear dicarboxylic acid contained in the polycondensate as a monomer component and the linear dialcohol having 2 to 12 carbon atoms is preferably 80% by weight or more, more preferably 90% by weight or more, and still more preferably 95% by weight or more, with respect to the entire monomer components contained in the polycondensate.

Examples of the linear dicarboxylic acid include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid.

Among these, as the linear dicarboxylic acid, linear dicarboxylic acid having 3 to 15 carbon atoms is preferable, and linear dicarboxylic acid having 5 to 12 carbon atoms is more preferable.

The linear dicarboxylic acids may be used singly or in combination of two or more types thereof.

Examples of the linear dialcohol having 2 to 12 carbon atoms include aliphatic diol such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

The carbon number of the linear dialcohol is 2 to 12, and is preferably 2 to 10, from the viewpoint of obtaining an appropriate compatibility state with the amorphous resin and an appropriate resistance difference with the amorphous resin.

The linear dialcohol may be used singly or in combination of two or more types thereof.

The melting temperature of the specific crystalline polyester resin is preferably 50° C. to 100° C., is more preferably 55° C. to 90° C., and is still more preferably 60° C. to 85° C.

The melting temperature may be determined as the "melting peak temperature", which is described in the section "Methods for Measuring Transition Temperatures of Plastics" in JIS K 7121-1987, from a DSC curve obtained by differential scanning calorimetry (DSC).

The weight average molecular weight (Mw) of the specific crystalline polyester resin is preferably in a range of 6,000 to 35,000 and is further preferably in a range of 7,000 to 15,000.

Similar to the amorphous polyester resin, the specific crystalline polyester resin can be obtained by a known production method.

Relationship Between Amorphous Resin and Specific Crystalline Polyester Resin

The content of the specific crystalline polyester resin with respect to the total amount of the amorphous resin and the specific crystalline polyester resin is 2% by weight to 40% by weight, is preferable 2% by weight to 20% by weight %, and is more preferable 4 by weight to 15% by weight from the viewpoint of low temperature fixability and image storage stability.

From the viewpoint of dispersibility of the external additive on the toner surface and prevention of charge leakage, a difference (ASP value) between a solubility parameter (SP value) of the crystalline polyester resin and a solubility parameter (SP value) of the amorphous resin is preferably 0.1 to 1.2, and is more preferably 0.5 to 1.0.

Here, the solubility parameter (SP value) of each resin is a value calculated by Fedors method (Polym. Eng. Sci., 14, 147 (1974)).

Regarding the solubility parameter (SP value) of the resin, for example, in a case where the resin is a polyester resin and an ethylene oxide adduct of bisphenol A is used as an alcohol component, by changing the ethylene oxide adduct to a propylene oxide adduct, the SP value of the resulting polyester resin can be lowered. In addition, in a case where the resin is a polyester resin and aliphatic dicarboxylic acid such as sebacic acid is used as the dicarboxylic acid used as an acid component, by changing the aliphatic dicarboxylic acid to the aromatic dicarboxylic acid such as terephthalic acid, the SP value can be increased.

The SP value of the resin may also be measured by examining the solubility in a solvent having a known SP value. It should be noted that actual compatibility between resins is also related to the interaction between the resins and is not necessarily determined by how much the SP value is. In the exemplary embodiment, the SP value is calculated by the above method (that is, the Fedors method).

Coloring Agent

Examples of the coloring agent includes various types of pigments such as carbon black, chrome yellow. Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride. Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agent may be used alone or two or more kinds thereof may be used in combination.

As the coloring agent, a surface-treated coloring agent may be used if necessary, and it may be used together with a dispersing agent. Further, plural kinds of the coloring agents may be used in combination.

The content of the coloring agent is preferably 1% by weight to 30% by weight, and is more preferably 3% by weight to 15% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably in a range of 50° C. to 110° C., and is further preferably in a range of 60° C. to 100° C.

The melting temperature may be determined as the "melting peak temperature", which is described in the section "Methods for Measuring Transition Temperatures of Plastics" in JIS K 7121-1987, from a DSC curve obtained by differential scanning calorimetry (DSC).

The content of the release agent is preferably 1% by weight to 20% by weight, and is more preferably 5% by weight to 15% by weight with respect to the entire toner particles.

Other Additives

Examples of other additives include well-known additives such as a magnetic material, a charge-controlling agent, and an inorganic powder. The toner particles may contain these additives as internal additives.

Further, as other additives (that is, internal additives), low molecular siloxane formed of only a siloxane bond and an alkyl group and having a molecular weight of 200 to 600 (hereinafter, also referred to as "low molecular siloxane")

may be used. In particular, in the second embodiment described above, it is preferable that the toner particles contain the low molecular siloxane as an internal additive.

By using the low molecular siloxane as the internal additive, the dispersibility of the incompatible portion of the specific crystalline polyester resin on the surface of the toner particles is improved, so that the uneven distribution of the external additive attached to the surface of the toner particles is prevented.

Details of the low molecular siloxane will be described later.

Properties of Toner Particles

The toner particles may have a single-layer structure or a so-called core and shell structure composed of a core (core particle) and a coating layer (shell layer) formed on the core.

Here, the toner particles having a core and shell structure are preferably composed of, for example, a core containing a binder resin, and if necessary, other additives such as a coloring agent and a release agent and a coating layer containing a binder resin.

The volume average particle diameter (D50v) of the toner particles is preferably 2 μm to 10 μm, and is more preferably 4 μm to 8 μm.

Various average particle diameters of the toner particles and various particle diameter distribution indices are measured using Coulter Multisizer II (manufactured by Beckman Coulter, Inc.), and the electrolytic solution is measured using ISOTON-II (manufactured by Beckman Coulter, Inc.).

In the measurement, 0.5 mg to 50 mg of a measurement sample is added to 2 ml of a 5% aqueous solution of a surfactant (preferably sodium alkyl benzene sulfonate) as a dispersing agent. The obtained material is added to 100 ml to 150 ml of an electrolyte.

The electrolyte containing the suspended sample is subjected to a dispersion treatment using an ultrasonic disperser for one minute, and the particle diameter distribution of particles having particle diameters in the range of 2 μm to 60 μm is measured using Coulter Multisizer II with an aperture having a diameter of 100 μm, in which 50.000 particles are sampled.

On the basis of the measured particle diameter distribution, the volume and number of particles are plotted from the small particle side in each divided particle diameter range (channel) to draw a cumulative distribution, in which volume particle diameter D16v or number particle diameter D16p is defined as the particle diameter at which the cumulative percentage is 160/%, volume average particle diameter D50v or number average particle diameter D50p is defined as the particle diameter at which the cumulative percentage is 50%, and volume particle diameter D84v or number particle diameter D84p is defined as the particle diameter at which the cumulative percentage is 84%.

Using these values, the volume particle diameter distribution index (GSDv) is calculated as $(D84v/D16v)^{1/2}$, and the number particle diameter distribution index (GSDp) is calculated as $(D84p/D16p)^{1/2}$.

The average circularity of the toner particles is preferably 0.94 to 1.00, and is more preferably 0.95 to 0.98.

The average circularity of the toner particles is calculated by (circumference length of equivalent circle diameter)/(circumference length) [(circumference length of circle having the same projected area as that of particle image)/(circumference length of particle projected image)]. Specifically, the aforementioned value is measured by using the following method.

The average circularity of the toner particles is calculated by using a flow particle image analyzer (FPIA-3,000 manufactured by Sysmex Corporation) which first, suctions and collects the toner particles to be measured so as to form flake flow, then captures a particle image as a static image by instantaneously emitting strobe light, and then performs image analysis of the obtained particle image. 3,500 particles are sampled at the time of calculating the average circularity.

In a case where the toner contains an external additive, the toner (the developer) to be measured is dispersed in the water containing a surfactant, and then the water is subjected to an ultrasonic treatment so as to obtain the toner particles in which the external additive is removed.

External Additive

The external additive includes at least silica particles (that is, specific silica particles) having a BET specific surface area of 100 $m^2/g$ or more, and may include any other external additive if necessary.

The content of the specific silica particles in the entire external additive is, for example, 10% by weight or more, is preferably 20% by weight to 80% by weight, and is more preferably 25% by weight to 60% by weight.

Specific Silica Particles

The specific silica particles are not particularly limited as long as they have a BET specific surface area of 100 $m^2/g$ or more.

The BET specific surface area of the specific silica particles is preferably 100 $m^2/g$ to 240 $m^2/g$, is more preferably 120 $m^2/g$ to 220 $m^2/g$, and is still more preferably 120 $m^2/g$ to 180 $m^2/g$, from the viewpoint of prevention of the detachment of the external additive.

The BET specific surface area of the specific silica particles is measured by a BET multipoint method using nitrogen gas.

The sample used for the measurement may be specific silica particles for use as a toner material or specific silica particles separated from the toner. The method for separating the specific silica particles from the toner is not limited. For example, after applying ultrasonic waves to a dispersion liquid in which toner is dispersed in water containing a surfactant, the dispersion liquid is centrifuged at a high speed, and a supernatant liquid is dried at room temperature (23° C.±2° C.) to obtain specific silica particles.

An average primary particle diameter of the specific silica particles is preferably 20 nm to 90 nm.

When the average primary particle diameter of the specific silica particles is 20 nm or more, they will be less likely to lie buried in the toner particles. From this viewpoint, the average primary particle diameter of sol-gel silica particles is more preferably 25 nm or more, and still more preferably 30 nm or more.

When the average primary particle diameter of the specific silica particles is 90 nm or less, the electrostatic repulsion to the toner particles is prevented, and thus the specific silica particles are likely to stay on the surface of the toner particles. From this viewpoint, the average primary particle diameter of the specific silica particles is more preferably 85 nm or more, and is still more preferably 80 nm or more.

In the exemplary embodiment, the primary particle diameter of the specific silica particles is a diameter of a circle having the same area as that of the primary particle image (so-called equivalent circle diameter), and is calculated by imaging an electron microscope image of the toner to which the specific silica particles are externally added, and image-analyzing at least 300 specific silica particles on the toner particles. The average primary particle diameter of the specific silica particles is a particle diameter that accumulates 50% from the side of the smallest diameter in the number-based distribution of the primary particle diameter.

The specific silica particles preferably have a weight reduction ratio of 1% by weight to 10% by weight when heated from 30° C. to 250° C. at a rate of temperature increase of 30° C./min. In addition, the weight reduction ratio indicates the quantity of water contained in the specific silica particles.

In a case where the weight reduction ratio is 1% by weight or more, the moderate moisture is retained on the surface of the specific silica particles, and thus the electrostatic repulsion between the toner particles and the specific silica particles is reduced, and the specific silica particles is less likely to separate. From this viewpoint, the weight reduction ratio is more preferably 2% by weight or more, and is more preferably 3% by weight or more.

When the weight reduction ratio is 10% by weight or less, the silica particles on the toner surface is less likely to be unevenly distributed and thus the dispersibility will be excellent. From this viewpoint, the weight reduction ratio is more preferably 9% by weight or less, and is more preferably 8% by weight or less.

In the exemplary embodiment, the weight reduction ratio when the specific silica particles are heated is obtained by the following measurement method.

30 mg of specific silica particles are put into a sample chamber of a micro thermogravimetric measuring apparatus (manufactured by Shimadzu Corporation, model number DTG-60AH), heated from 30° C. to 250° C. at a rate of temperature increase of 30° C./min, and the weight reduction ratio is calculated from the difference from the initial weight.

The sample used for the micro thermogravimetric measuring apparatus may be specific silica particles for use as a toner material or specific silica particles separated from the toner. The method for separating the specific silica particles from the toner is not limited. For example, after applying ultrasonic waves to a dispersion liquid in which toner is dispersed in water containing a surfactant, the dispersion liquid is centrifuged at a high speed, and a supernatant liquid is dried at room temperature (23° C.±2° C.) to obtain specific silica particles.

Examples of the specific silica particles include sol-gel silica particles.

The sol-gel silica particles are obtained, for example, as follows.

Tetraalkoxysilane is dropped into an alkali catalyst solution containing an alcohol compound and aqueous ammonia, and the tetraalkoxysilane is hydrolyzed and condensed to obtain a suspension containing the sol-gel silica particles. Next, the solvent is removed from the suspension to obtain a granular material. Next, the granular material is dried to obtain sol-gel silica particles.

The average primary particle diameter of the sol-gel silica particles is controlled by the dripping amount of tetraalkoxysilane to the amount of the alkali catalyst solution.

Further, the BET specific surface area of the sol-gel silica particles is controlled by the hydrophobization conditions, the abundance ratio of water and methanol contained in the particles, and the like.

In addition, the amount of water contained in the sol-gel silica particles, that is, the weight reduction ratio when heated from 30° C. to 250° C. at a rate of temperature increase of 30° C./min is controlled by the drying conditions at the time of drying the granular material.

The sol-gel silica particles may be hydrophobic sol-gel silica particles that have been subjected to a hydrophobic surface treatment. A hydrophobization treating agent is not particularly limited, and a silicon-containing organic compound is preferable. Examples of the silicon-containing organic compound include an alkoxysilane compound, a silazane compound, and a silicone oil. These may be used alone or two or more kinds thereof may be used in combination.

The hydrophobization treating agent for the sol-gel silica particles is preferably a silazane compound (for example, dimethyl disilazane, trimethyl disilazane, tetramethyl disilazane, pentamethyl disilazane, and hexamethyl disilazane), is particularly preferably 1,1,1,3,3,3-hexamethyl disilazane (HMDS).

Even in a case where the sol-gel silica particles are the hydrophobic sol-gel silica particles that have been subjected to a hydrophobic surface treatment, the weight reduction ratio when heated is preferably in the above-described range, and the average primary particle diameter is preferably in the above-described range.

The externally added amount of the specific silica particles is preferably 0.01% by weight to 10% by weight, is more preferably 0.05% by weight to 5% by weight, and is still more preferably 0.1% by weight to 2.5% by weight, with respect to the weight of the toner particles.

Other external additives Examples of other external additives include inorganic particles other than the specific silica particles. Examples of the inorganic particles include $SiO_2$, $Tio_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO{\cdot}SiO_2$, $K_2O{\cdot}(TiO_2)n$, $Al_2O_3{\cdot}2SiO_2$, $CaCO_3$, $MgCO_3$, $BaSO_4$, and $MgSO_4$ other than the specific silica particles.

The surface of the inorganic particles as other external additives may be subjected to a hydrophobization treatment. The hydrophobization treatment is performed, for example, by immersing inorganic particles in a hydrophobization treating agent. The hydrophobization treating agent is not particularly limited, and examples thereof include a silane coupling agent, a silicone oil, a titanate coupling agent, and an aluminum coupling agent. These may be used alone or two or more kinds thereof may be used in combination.

The amount of the hydrophobization treating agent is generally, for example, 1 part by weight to 10 parts by weight respect to 100 parts by weight of the inorganic particles.

Examples of other external additives include resin particles (resin particles such as polystyrene, polymethyl methacrylate (PMMA), and melamine resin), a cleaning aid (such as a metal salt of higher fatty acid represented by zinc stearate, and particles of a fluorine polymer).

Among these, silica particles other than the specific silica particles (specifically, silica particles having a BET specific surface area of less than 100 $m^2/g$) are preferable as other external additives. By using such silica particles other than the specific silica particles as the other external additives, a decrease in charging performance is prevented in a case where the detached external additive contaminates the carrier. With this, the detachment of the external additive when being subjected to a mechanical stress in the developing machine for a long time is prevented, and a high-quality image excellent in transferability in a high temperature and high humidity environment is provided in a long time period.

The total content of the specific silica particles and those other than the specific silica particles is, for example, 80% by weight or more, is preferably 90% by weight or more, and is more preferably 95% by weight with respect to the entire external additive.

Overall External Additives

The low molecular siloxane formed of only a siloxane bond and an alkyl group and having a molecular weight of 200 to 600 (that is, low molecular siloxane) may be attached to the surface of the external additive. In particular, in the first embodiment described above, it is preferable that the low molecular siloxane may be attached to the surface of the external additive. In a case where the external additive includes the specific silica particles and other external additives, the low molecular siloxane may be attached to the surface of the specific silica particles, low molecular siloxane may be attached to the surface of the other external additive, and the low molecular siloxane may be attached to both surfaces of the specific silica particles and other external additive.

Since the low molecular siloxane is attached to the surface of the external additive, the electrostatic repulsion between the toner particles and the external additive is further prevented, and the detachment of the external additive is prevented.

Note that, in a case where the external additive is the hydrophobic sol-gel silica particles that have been subjected to the hydrophobic surface treatment as described above, the low molecular siloxane is preferably attached to the surface of the sol-gel silica particles after the hydrophobic treatment.

Details of the low molecular siloxane will be described later.

The total amount of the external additives is preferably 0.01% by weight to 5% by weight, and is more preferably 1.0% by weight to 4.0% by weight with respect to the toner particles.

The total content of external additives contained in the toner is obtained by the following measurement method.

After applying ultrasonic waves to a dispersion liquid in which toner is dispersed in water containing a surfactant, the dispersion liquid is centrifuged at a high speed, a supernatant liquid is dried at room temperature (23° C.±2° C.) to obtain an external additive, and then the external additive obtained from the supernatant liquid is weighed. Here, the low molecular siloxane may be attached to the surface of the external additive obtained from the supernatant, but the content of the attached low molecular siloxane is negligibly small compared to the external additive.

Low Molecular Siloxane

The toner may contain the low molecular siloxane consisting essentially of siloxane bonds and alkyl groups and having a molecular weight of 200 to 600 (that is, low molecular siloxane) if necessary.

Here, unless otherwise specified, siloxane in the present specification refers to a compound formed only of a siloxane bond and an alkyl group. In the present specification, siloxane having a molecular weight of 1000 or more is referred to as a silicone oil.

The low molecular siloxane may be contained, for example, as an internal additive inside the toner particles, may be contained in a state of being attached to the surface of the external additive, or may be contained in both of the inside the toner particles and the surface of the external additive.

The molecular weight of the low molecular siloxane is 200 or more, is preferably 250 or more, is more preferably 280 or more, and is still more preferably 300 or more. Further, the molecular weight of the low molecular siloxane is 600 or less, is preferably 550 or less, is more preferably 500 or less, and is still more preferably 450 or less.

In a case where the low molecular siloxane is used as an internal additive, when the molecular weight of the low molecular siloxane is in the above range, there are advantages that the dispersibility of the incompatible portion becomes excellent as compared with a case where the molecular weight is smaller than the above range, and the dispersibility is uniformly excellent in the toner as compared with the case where the molecular weight is larger than the above range.

In a case where the low molecular siloxane is used by being attached to the surface of the external additive, when the molecular weight of the low molecular siloxane is in the above range, there is are advantages that the aggregation of siloxane is prevented as compared to the case where the molecular weight is smaller than the above range, and the electrostatic repulsion of the silica particles can be reduced as compared with the case where the molecular weight is larger than the above range.

In the low molecular siloxane, the number of Si atoms in one molecule is at least two.

In the low molecular siloxane, from the viewpoint of preventing the electrostatic repulsion between the toner particles and the external additive, the number of Si atoms in one molecule is preferably three or more, is more preferably four or more, and is still more preferably five or more.

In the low molecular siloxane, from the viewpoint of preventing the electrostatic repulsion between the toner particles and the external additive, the number of Si atoms in one molecule is preferably seven or less, is more preferably six or less, and is still more preferably five or less.

From the above viewpoints, in the low molecular siloxane, the number of the Si atoms in one molecule is particularly preferably five.

The kinematic viscosity of the low molecular siloxane at 25° C. is preferably 2 $mm^2/s$ to 5 $mm^2/s$ from the viewpoint of the dispersibility of the siloxane in the toner and the external additive.

In the exemplary embodiment, the kinematic viscosity ($mm^2/s$) of siloxane is a value obtained by dividing the viscosity at 25° C. measured using an Ostwald viscometer which is a kind of capillary viscometer by the density.

As an example of the low molecular siloxane, a linear low molecular siloxane with no branched siloxane bonds (hereinafter, also referred to as "low molecular linear siloxane") is exemplified.

Examples of the low molecular linear siloxane include hexaalkyl disiloxane, octaalkyl trisiloxane, decaalkyl tetrasiloxane, dodecaalkyl pentasiloxane, tetradecaalkyl hexasiloxane, and hexadecaalkyl heptasiloxane (here, the molecular weight is 200 to 600).

Examples of the alkyl group that these low molecular linear siloxanes have include a linear alkyl group having 1 to 10 carbon atoms (preferably 1 to 6 carbon atoms, more preferably 1 to 3 carbon atoms, and still more preferably 1 or 2 carbon atoms), a branched alkyl group having 3 to 10 carbon atoms (preferably 3 to 6 carbon atoms and more preferably 3 or 4 carbon atoms), and a cyclic alkyl group having 3 to 10 carbon atoms (preferably 3 to 6 carbon atoms and more preferably 3 or 4 carbon atoms). Among these, an alkyl group having 1 to 3 carbon atoms is preferable, at least one of a methyl group and an ethyl group is preferable, and a methyl group is more preferable. The plural alkyl groups in one molecule of the low molecular linear siloxane may be the same as or different from each other.

Specific examples of the low molecular linear siloxane include octamethyl trisiloxane, decamethyl tetrasiloxane, dodecamethyl pentasiloxane, tetradecamethyl hexasiloxane, and hexadecamethyl heptasiloxane.

As an example of the low molecular siloxane, a branched low molecular siloxane having a branched siloxane bond (hereinafter, also referred to as "low molecular branched siloxane") is exemplified.

Examples of the low molecular branched siloxane include branched siloxanes such as 1,1,1,3,5,5,5-heptaalkyl-3-(trialkylsiloxy) trisiloxane, tetrakis (trialkylsiloxy) silane, and 1,1,1,3,5,5,7,7,7-nonaalkyl-3-(trialkylsiloxy) tetrasiloxane (here, the molecular weight is 200 to 600).

Examples of the alkyl group that these low molecular branched siloxanes have include a linear alkyl group having 1 to 10 carbon atoms (preferably 1 to 6 carbon atoms, more preferably 1 to 3 carbon atoms, and still more preferably 1 or 2 carbon atoms), a branched alkyl group having 3 to 10 carbon atoms (preferably 3 to 6 carbon atoms and more preferably 3 or 4 carbon atoms), and a cyclic alkyl group having 3 to 10 carbon atoms (preferably 3 to 6 carbon atoms and more preferably 3 or 4 carbon atoms). Among these, an alkyl group having 1 to 3 carbon atoms is preferable, at least one of a methyl group and an ethyl group is preferable, and a methyl group is more preferable. The plural alkyl groups in one molecule of the low molecular branched siloxane may be the same as or different from each other.

Specific examples of the low molecular branched siloxane include methyltris (trimethylsiloxy) silane (molecular formula $C_{10}H_{30}O_3Si_4$), tetrakis (trimethylsiloxy) silane (molecular formula $C_{12}H_{36}O_4Si_5$), and 1,1,1,3,5,5,7,7,7-nonamethyl-3-(trimethylsiloxy) tetrasiloxane (molecular formula $C_{12}H_{36}O_4Si_5$).

As an example of the low molecular siloxane, a cyclic low molecular siloxane having a cyclic structure formed only of a siloxane bond (hereinafter, also referred to as "low molecular cyclic siloxane") is exemplified.

Examples of the low molecular cyclic siloxane include hexaalkyl cyclotrisiloxane, octaalkyl cyclotetrasiloxane, decaalkyl cyclopentasiloxane, dodecaalkyl cyclohexasiloxane, tetradecaalkyl cycloheptasiloxane, and hexadecaalkyl cyclooctasiloxane (here, the molecular weight is 200 to 600).

Examples of the alkyl group that these low molecular cyclic siloxanes have include a linear alkyl group having 1 to 10 carbon atoms (preferably 1 to 6 carbon atoms, more preferably 1 to 3 carbon atoms, and still more preferably 1 or 2 carbon atoms), a branched alkyl group having 3 to 10 carbon atoms (preferably 3 to 6 carbon atoms and more preferably 3 or 4 carbon atoms), and a cyclic alkyl group having 3 to 10 carbon atoms (preferably 3 to 6 carbon atoms and more preferably 3 or 4 carbon atoms). Among these, an alkyl group having 1 to 3 carbon atoms is preferable, at least one of a methyl group and an ethyl group is preferable, and a methyl group is more preferable. The plural alkyl groups in one molecule of the low molecular cyclic siloxane may be the same as or different from each other.

Specific examples of the low molecular cyclic siloxane include hexamethyl cyclotrisiloxane, octamethyl cyclotetrasiloxane, decamethyl cyclopentasiloxane, dodecamethyl cyclohexasiloxane, tetradecamethyl cycloheptasiloxane, and hexadecamethyl cyclooctasiloxane.

As the low molecular siloxane, at least one selected from the group consisting of low molecular linear siloxane and low molecular branched siloxane is preferable, the low molecular branched siloxane is more preferable, and the low molecular siloxane having a tetrakis structure is still more preferable, from the viewpoint of prevention of detachment of the external additive and prevention of uneven distribution of the external additives. The siloxane having a tetrakis structure refers to siloxane having at least one of the following structures (that is, a tetrakisoxysilane structure) in the molecule.

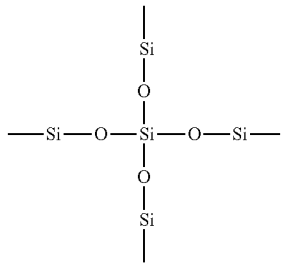

Examples of the low molecular siloxane having a tetrakis structure include tetrakis (trialkylsiloxy)silane, and examples of the alkyl group include a linear alkyl group having 1 to 10 carbon atoms (preferably 1 to 6 carbon atoms, more preferably 1 to 3 carbon atoms, and still more preferably 1 or 2 carbon atoms), a branched alkyl group having 3 to 10 carbon atoms (preferably 3 to 6 carbon atoms and more preferably 3 or 4 carbon atoms), and a cyclic alkyl group having 3 to 10 carbon atoms (preferably 3 to 6 carbon atoms and more preferably 3 or 4 carbon atoms). Among these, an alkyl group having 1 to 3 carbon atoms is preferable, at least one of a methyl group and an ethyl group is preferable, and a methyl group is more preferable. The alkyl groups in one molecule of the low molecular siloxane having a tetrakis structure may be the same as or different from each other.

As the low molecular siloxane, tetrakis (trimethylsiloxy) silane is particularly preferable from the viewpoint of prevention of detachment of the external additive and prevention of uneven distribution of the external additives.

The total content of low molecular siloxanes contained in the toner is preferably 0.01 ppm or more, is more preferably 0.05 ppm or more, and is still more preferably 0.1 ppm or more with respect to the weight of the toner, from the viewpoint of prevention of detachment of the external additive and prevention of uneven distribution of the external additives.

The total content of the low molecular siloxanes contained in the toner is preferably 10 ppm or less, is more preferably 5 ppm or less, is still more preferably 1 ppm or less, and is particularly preferably 0.5 ppm or less with respect to the weight of the toner from the viewpoint of preventing the detachment of the external additive and preventing the decrease in toner conductivity. Note that, "ppm" is an abbreviation for "parts per million" and is based on weight.

The total content of the low molecular siloxanes contained in the toner is measured by a headspace method with a gas chromatograph weight spectrometer (manufactured by Shimadzu Corporation, GCMS-QP2020) and a nonpolar column (manufactured by Restek, Rtx-1, 10157, a film thickness of 1.00 μm, a length of 60 m, and an inner diameter of 0.32 mm). A specifying method will be described in detail as follows.

The toner is weighed into a vial bottle, the vial bottle is capped and sealed, and the temperature is raised to 190° C. for a heating time of 3 minutes. Next, a volatile component in the vial bottle is introduced into the column, and the low molecular siloxane having a molecular weight of 200 to 600 is detected under the following conditions. The total amount of the low molecular siloxane is calculated from the total area of the peaks corresponding to the low molecular siloxane and a calibration curve of a reference substance (tetrakis(trimethylsiloxy)silane), and the total content (ppm) of the low molecular siloxane with respect to the total amount of the toner is calculated.

Carrier gas type: Helium

Carrier gas pressure: 120 kPa (constant pressure)

Oven temperature: 40° C. (5 minutes)→(15° C./min) →250° C. (6 minutes) (25 minutes in total) Ion source temperature: 260° C.

Interface temperature: 260° C.

The total content of the low molecular siloxanes contained in the toner is preferably 10 ppm or more, is more preferably 15 ppm or more, and is still more preferably 20 ppm or more with respect to the total content of external additives contained in the toner from the viewpoint of preventing the detachment of the external additives.

From the viewpoint of preventing the detachment of the crystalline polyester resin from the toner due to the extremely high dispersibility of the incompatible portion, the total content of the low molecular siloxanes contained in the toner is preferably 1000 ppm or less, is more preferably 500 ppm or less, is still more preferably 200 ppm or less, and is even more preferably 100 ppm or less with respect to the total content of the external additives in the toner.

The above weight ratio is a value obtained by converting {total content of low molecular siloxanes contained in toner+total content of external additives contained in toner}into parts per million.

Method of Preparing Toner

Next, a method of producing toner of the exemplary embodiment will be described.

The toner according to the exemplary embodiment can be obtained by externally adding an external additive to the toner particles after producing the toner particles.

The toner particles may be produced by using any one of a drying method (for example, a kneading and pulverizing method) and a wetting method (for example, an aggregation and coalescence method, a suspension polymerization method, and a dissolution suspension method). The preparing method of the toner particles is not particularly limited, and well-known method may be employed.

Among them, the toner particles may be obtained by using the aggregation and coalescence method.

Specifically, for example, in a case where the toner particles are produced by using the aggregation and coalescence method, the toner particles are produced through the following steps. The steps include a step (a resin particle dispersion preparing step) of preparing a resin particle dispersion in which resin particles constituting the binder resin are dispersed, a step (an aggregated particle forming step) of forming aggregated particles by aggregating the resin particles (other particles if necessary), in the resin particle dispersion (in the dispersion in which other particle dispersions are mixed, if necessary); and a step (a coalescence step) of forming toner particles by coalescing aggregated particles by heating an aggregated particle dispersion in which aggregated particles are dispersed.

Hereinafter, the respective steps will be described in detail.

In the following description, a method of obtaining toner particles including the coloring agent and the release agent will be described; however, the coloring agent and the release agent are used if necessary. Other additives other than the coloring agent and the release agent may also be used.

Resin Particle Dispersion Preparing Step

First, together with a resin particle dispersion in which the resin particles corresponding to the binder resins are dispersed, a coloring agent particle dispersion in which coloring agent particles are dispersed, and a release agent particle dispersion in which the release agent particles are dispersed are prepared, for example.

Here, the resin particle dispersion is, for example, produced by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used alone or two or more kinds thereof may be used in combination.

Examples of the surfactant include anionic surfactants such as sulfate, sulfonate, phosphate, and soap anionic surfactants: cationic surfactants such as amine salt and quaternary ammonium salt cationic surfactants; and nonionic surfactants such as polyethylene glycol, alkyl phenol ethylene oxide adduct, and polyhydric alcohol. Among them, anionic surfactants and cationic surfactants are particularly preferable. Nonionic surfactants may be used in combination with anionic surfactants or cationic surfactants.

The surfactants may be used alone or two or more kinds thereof may be used in combination.

In the resin particle dispersion, as a method of dispersing the resin particles in the dispersion medium, a common dispersing method by using, for example, a rotary shearing-type homogenizer, a ball mill having media, a sand mill, or a Dyno mill is exemplified.

Further, depending on the kinds of the resin particles, the resin particles may be dispersed in the resin particle dispersion by using, for example, a phase inversion emulsification method.

The phase inversion emulsification method is a method of dispersing a resin in an aqueous medium in a particle form by dissolving a resin to be dispersed in a hydrophobic organic solvent in which the resin is soluble, conducting neutralization by adding a base to an organic continuous phase (O phase), and performing inversion (so called phase inversion) of the resin from W/O to O/W to make discontinuous phase by adding an aqueous medium (W phase).

The volume average particle diameter of the resin particles dispersed in the resin particle dispersion is, for example, preferably from 0.01 μm to 1 μm, is more preferably from 0.08 μm to 0.8 μm, and is still more preferably from 0.1 μm to 0.6 μm.

Regarding the volume average particle diameter of the resin particles, a cumulative distribution by volume is drawn from the smallest diameter side for each divided particle diameter range (channel) on the basis of the particle diameter distribution obtained by the measurement with a laser diffraction-type particle diameter distribution measuring device (for example, LA-700 manufactured by Horiba, Ltd.), in which volume average particle diameter D50v is defined as the particle diameter at which the cumulative percentage is 50% with respect to the entire particles. The volume average particle diameter of particles in other dispersion liquids may also be determined in the same manner.

The content of the resin particles contained in the resin particle dispersion is preferably from 5% by weight to 50% by weight, and is more preferably from 10% by weight to 40% by weight.

Note that, the coloring agent particle dispersion and the release agent particle dispersion are also produced in the same manner as in the case of the resin particle dispersion.

That is, the volume average particle diameter of the particles in the resin particle dispersion, dispersion medium, the dispersing method, and the content of the particles are the same as those in the coloring agent particles dispersed in the coloring agent particle dispersion and the release agent particles dispersed in the release agent particle dispersion.

Aggregated Particle Forming Step

Next, the resin particle dispersion, the coloring agent particle dispersion, and the release agent particle dispersion are mixed with each other.

In addition, in the mixed dispersion, the resin particles, the coloring agent particles, and the release agent particles are heteroaggregated, and thereby aggregated particles which have a diameter close to a targeted diameter of the toner particles and contain the resin particles, the coloring agent particles, and the release agent particles are formed.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass-transition temperature of the resin particles (specifically, for example, in a range of glass-transition temperature of −30° C. to glass-transition temperature of −10° C. of the resin particles) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, a divalent or more metal complex. Particularly, when a metal complex is used as the aggregating agent, the amount of the surfactant used is reduced and charging properties are improved.

An additive for forming a bond of metal ions as the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and is more preferably equal to or greater than 0.1 parts by weight and less than 3.0 parts by weight, with respect to 100 parts by weight of resin particles.

Coalescence Step

Next, the aggregated particle dispersion in which the aggregated particles are dispersed is heated at, for example, a temperature that is equal to or higher than the glass-transition temperature of the resin particles (for example, a temperature that is higher than the glass-transition temperature of the resin particles by 10° C. to 30° C.) to perform the coalesce on the aggregated particles and form toner particles.

The toner particles are obtained through the foregoing steps.

Note that, the toner particles may be obtained through a step of forming a second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so as to attach the resin particles on the surface of the aggregated particles, and a step of forming the toner particles having a core/shell structure by heating a second aggregated particle dispersion in which the second aggregated particles are dispersed, and coalescing the second aggregated particles.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like may be performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is produced, for example, by adding an external additive to the obtained toner particles in the dry state and mixing them. The mixing may be performed by using, for example, a V blender, a Henschel mixer, a Loedige mixer, or the like. Furthermore, if necessary, coarse particles of the toner may be removed by using a vibration sieving machine, a wind classifier, or the like.

Properties of Toner $\Delta H2/\Delta H1$ value

The $\Delta H2/\Delta H1$ value in the toner is 0.05 to 0.95 as described above, is preferably 0.08 to 0.95, is more preferably 0.10 to 0.80, and is still more preferably 0.12 to 0.80.

In the first embodiment, the $\Delta H2/\Delta H1$ value in the toner is greater than 0.35 and 0.95 or less, and is preferably 0.45 to 0.80.

Furthermore, in the second embodiment, the $\Delta H2/\Delta H1$ value in the toner is 0.05 to 0.35, is preferably 0.08 to 0.32, is more preferably 0.10 to 0.30, is still more preferably 0.12 to 0.28, and is still more preferably 0.15 or greater and less than 0.25.

Note that, the fact that the $\Delta H2/\Delta H1$ value is greater than 0.35 and 0.95 or less means that there is a portion where the crystalline resins are unevenly distributed in the toner as compared with the case where the $\Delta H2/\Delta H1$ value is greater than 0.95. Therefore, it is considered that in the toner having the $\Delta H2/\Delta H1$ value of greater than 0.35 and 0.95 or less, the compatibility between the amorphous resin and the specific crystalline polyester resin is not too high and an appropriate compatible state is obtained, and the incompatible portion of the fine specific crystalline polyester resin is dispersed on the surface of the toner particles, as compared with the toner having the $\Delta H2/\Delta H1$ value of greater than 0.95. In addition, a conductive path is easily formed by the incompatible portion of the specific crystalline polyester resins dispersed on the surface of the toner particles, and the electrostatic repulsion between the toner particles and the external additive is reduced, thereby preventing the detachment of the external additive from the toner particles.

Further, as compared with the toner having the ΔH2/ΔH1 value of 0.35 or less, in the toner having the ΔH2/ΔH1 value of greater than 0.35, the compatibility between the amorphous resin and the specific crystalline polyester resin is high, the incompatible portion of the fine specific crystalline polyester resin is dispersed on the surface of the toner particles, a conductive path is easily formed, and the electrostatic repulsion is prevented, thereby preventing the detachment of the external additive from the toner particles.

The fact that the ΔH2ΔH1 value is 0.05 or more means that a compatible portion of an amorphous resin and a specific crystalline polyester resin exists as compared with a case where the ΔH2/ΔH1 value is less than 0.05. Therefore, the toner having the ΔH2/ΔH1 value of 0.05 or greater has high compatibility between the amorphous resin and the specific crystalline polyester resin as compared with the toner having the ΔH2/ΔH1 value of less than 0.05. With this, since the uneven distribution of the incompatible portion of the specific crystalline polyester resin on the surface of the toner particles is prevented, by preventing the burying of the external additive in the incompatible portion of the specific crystalline polyester resin, the uneven distribution of the external additive attached to the surface of the toner particles is prevented, and the electrostatic repulsion is reduced, thereby preventing the detachment of the external additive from the toner particles.

In addition, as compared with the toner having a ΔH2/ΔH1 value of greater than 0.35, the toner having the ΔH2/ΔH1 value of 0.35 or less has an advantage that storage stability is improved in the long term period due to the fact that the compatible portion between the amorphous resin and the specific crystalline polyester resin does not excessively increase and the cohesiveness at room temperature (23° C.±2° C.) is difficult to deteriorate.

Coverage Ratio of External Additive

The coverage ratio of the external additive on the surface of the toner particles is preferably 80% or more, is more preferably 83% or more, and is still more preferably 85% or more.

When the coverage ratio of the external additive is 80% or more, an increase in the adhesive force due to exposure of the surface of the toner particles is prevented, and deterioration in the transferability due to the increase in the adhesive force is prevented.

In particular, when the coverage ratio of the external additive is 80%0 or more and the particle diameter of the specific silica particles is 20 nm to 80 nm, the increase in the adhesive force due to the exposure of the surface of the toner particles is prevented, and even if the slightly detached external additive contaminates the carrier, a decrease in the charging performance is prevented. With this, the detachment of the external additive when being subjected to a mechanical stress in the developing machine is prevented, and a high-quality image excellent in transferability in a high temperature and high humidity environment is provided in a long time period.

The coverage ratio of the external additive is obtained by the following method.

(1) A measurement sample is prepared by dispersing toner in an epoxy resin and allowing it to stand for one day and night to solidify. For example, a two-component mixed epoxy resin may be used as the epoxy resin.

(2) A section having a thickness of 100 nm is cut out from the measurement sample with a microtome.

(3) The section is placed on a copper mesh, set in a high resolution electron microscope JEM-2010 (JEOL Ltd.), and imaged at an applied voltage of 200 kV and 500,000 times magnification.

(4) A negative is stretched from 3 times to 10 times and printed.

(5) A surface of the toner having a diameter of 80% to 120% of the volume average particle diameter of the toner is observed by printing according to the procedures of (1) to (4), and a surface coating state of the external additive with respect to the entire toner surface is evaluated. The coverage ratio is obtained from the following expression.

Coverage ratio=(Coating length/Toner peripheral length)×100(%) Expression:

Here, the coating length refers to the length of the external additive layer that is in direct contact with the surface of the toner particles.

In the exemplary embodiment, the average of the coverage ratio of 10 toners is defined as a coverage ratio.

Fluidity Index of Toner

The fluidity index of the toner stored for 24 hours in an environment of temperature of 50° C. and humidity of 50% is preferably 20 or less, is more preferably 19 or less, and is still more preferably 18 or less.

A toner having a fluidity index in the above range has excellent fluidity even when a load is applied at high temperature and high humidity, and thus the toners are less likely to aggregate with each other and transfer of the external additive on the wall surface of the cartridge is small.

The above fluidity index is obtained as follows.

Using a powder tester (manufactured by Hosokawa Micron Corporation), sieves having openings of 53 μm, 45 μm, and 38 μm are arranged in series from the upper stage. 2 g of accurately weighed toner is put on a sieve having a mesh size of 53 μm, vibrated for 90 seconds with an amplitude of 1 mm, the toner weight on each sieve after vibration is measured, and a fluidity index is obtained from the following expression.

Fluidity index (%)=[(toner weight on sieve having opening of 53 μm)×0.5+(toner weight on sieve having opening of 45 μm)×0.3+(toner weight on sieve having opening of 38 μm)×0.1]×100/(toner weight used for measurement) Expression:

Electrostatic Charge Image Developer

The electrostatic charge image developer according to the exemplary embodiment contains at least the toner according to the exemplary embodiment.

The electrostatic charge image developer according to the exemplary embodiment may be a one-component developer containing only the toner according to the exemplary embodiment, or may be a two-component developer in which the toner and the carrier are mixed with each other.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particles are mixed and dispersed in the matrix resin: and a resin impregnated-type carrier in which a resin is impregnated into the porous magnetic particles.

Note that, the magnetic particle dispersion-type carrier and the resin impregnated-type carrier may be a carrier in which the forming particles of the aforementioned carrier is set as a core and the core is coated with the coating resin.

Examples of the magnetic particles include magnetic metals such as iron, nickel, and cobalt, and magnetic oxides such as ferrite, and magnetite.

Examples of the coating resin and the matrix resin include a straight silicone resin formed by containing polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and an organosiloxane bond, or the modified products thereof, a fluororesin, polyester, polycarbonate, a phenol resin, and an epoxy resin.

The coating resin and the matrix resin may contain other additives such as conductive particles.

Examples of the conductive particles include metal such as gold, silver, and copper, and particles such as carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of toner to carrier in the two-component developer is preferably toner:carrier=1:100 to 30:100, and is more preferably 3:100 to 20:100.

Image Forming Apparatus and Image Forming Method

An image forming apparatus and an image forming method according to this exemplary embodiment will be described.

The image forming apparatus according to the exemplary embodiment is provided with an image holding member, a charging unit that charges the surface of the image holding member, an electrostatic charge image forming unit that forms an electrostatic charge image on the charged surface of the image holding member, a developing unit that accommodates an electrostatic charge image developer, and develops the electrostatic charge image formed on the surface of the image holding member as a toner image by using the electrostatic charge image developer, a transfer unit that transfers the toner image formed on the surface of the image holding member to a surface of a recording medium, and a fixing unit that fixes the toner image transferred onto the surface of the recording medium. In addition, the electrostatic charge image developer according to the exemplar) embodiment is used as the electrostatic charge image developer.

In the image forming apparatus according to the exemplary embodiment, an image forming method (the image forming method according to the exemplary embodiment) including a step of charging a surface of an image holding member, a step of forming an electrostatic charge image on the charged surface of the image holding member, a step of developing an electrostatic charge image formed on the surface of the image holding member as a toner image with the electrostatic charge image developer according to the exemplary embodiment, a step of transferring the toner image formed on the surface of the image holding member to a surface of a recording medium, and a step of fixing the toner image transferred to the surface of the recording medium is performed.

As the image forming apparatus according to the exemplary embodiment, well-known image forming apparatuses such as a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the surface of the intermediate transfer member to the surface of the recording medium; an apparatus including a cleaning unit that cleans the surface of the image holding member before being charged and after transferring the toner image; and an apparatus includes an erasing unit that erases charges by irradiating the surface of the image holding member with erasing light before being charged and after transferring the toner image.

In a case where the intermediate transfer type apparatus is used, the transfer unit includes an intermediate transfer member having a surface to which the toner image is to be transferred, a first transfer unit that primarily transfers the toner image formed on the surface of the image holding member to the surface of the intermediate transfer member, and a second transfer unit that secondarily transfers the toner image transferred on the surface of the intermediate transfer member to the surface of the recording medium.

In the image forming apparatus according to the exemplary embodiment, for example, a unit including the developing unit may be a cartridge structure (process cartridge) attachable to and detachable from the image forming apparatus. As a process cartridge, for example, a process cartridge including the developing unit accommodating the electrostatic charge image developer in the exemplary embodiment is preferably used.

Hereinafter, a non-limiting example of the image forming apparatus according to this exemplary embodiment will be described. Major parts shown in the drawing will be described while descriptions of other parts will be omitted.

FIG. 1 is a schematic configuration diagram illustrating an image forming apparatus according to the exemplary embodiment.

The image forming apparatus as illustrated in FIG. 1 is provided with electrophotographic first to fourth image forming units 10Y, 10M, 10C, and 10K (image forming means) that output an image of each color of yellow (Y), magenta (M), cyan (C), and black (K) based on color separated image data. These image forming units (hereinafter, referred to simply as "units" in some cases) 10Y, 10M, 10C, and 10K are arranged in parallel in the horizontal direction with a predetermined distance therebetween. Note that, these units 10Y, 10M, 10C, and 10K may be a process cartridge which is attached to and detached from the image forming apparatus.

On the upper side of the respective units 10Y. 10M, 10C, and 10K in the drawing, an intermediate transfer belt 20 as an intermediate transfer member is extended through the respective units. The intermediate transfer belt 20 is wound around a drive roll 22 and a support roll 24 in contact with the inner surface of the intermediate transfer belt 20, which are spaced apart from each other in the left to right direction in the drawing, and travels in the direction from the first unit 10Y to the fourth unit 10K. A force is applied to the support roll 24 in a direction away from the drive roll 22 by a spring or the like (not shown), and a tension is applied to the intermediate transfer belt 20 wound around both. An intermediate transfer member cleaning device 30 is provided on the side surface of the image holding member of the intermediate transfer belt 20 so as to face the drive roll 22.

In addition, the toners including four color toners of yellow, magenta, cyan, and black contained in toner cartridges 8Y, 8M. 8C, and 8K are supplied to the developing machines (developing unit) 4Y, 4M, 4C, and 4K of the units 10Y. 10M, 10C, and 10K, respectively.

Since the first to fourth units 10Y, 10M, 10C, and 10K have the same configuration, here, the first unit 10Y for forming a yellow image, which is disposed upstream in the traveling direction of the intermediate transfer belt, will be described as a representative. By denoting reference numerals with magenta (M), cyan (C), and black (K) instead of yellow (Y) to the same portions as those in the first unit 10Y, description of the second to fourth units 10M, 10C, and 10K will not be made.

The first unit 10Y includes a photosensitive body 1Y which functions as an image holding member. Around the photosensitive body 1Y, a charging roll (an example of the charging unit) 2Y that charges the surface of the photosensitive body 1Y to a predetermined potential, an exposure device (an example of the electrostatic charge image forming unit) 3 that forms an electrostatic charge image by exposing the charged surface with a laser beam 3Y based on a color separated image signal, a developing machine (an example of the developing unit) 4Y that develops an electrostatic charge image by supplying toner charged to the electrostatic charge image, a first transfer roll 5Y (an example of the first transfer unit) that transfers the developed toner image onto the intermediate transfer belt 20, and a photosensitive body cleaning device (an example of the cleaning unit) 6Y that removes the toner remaining on the surface of the photosensitive body 1Y after first transfer are arranged in order.

The first transfer roll 5Y is disposed on the inner side of the intermediate transfer belt 20, and is provided at a position facing the photosensitive body 1Y. Further, a bias power supply (not shown) for applying a first transfer bias is connected to each of the first transfer rolls 5Y, 5M, 5C, and 5K. Each bias power supply varies the transfer bias applied to each first transfer roll under the control of a control unit (not shown).

Hereinafter, an operation of forming a yellow image in the first unit 10Y will be described.

First, prior to the operation, the surface of the photosensitive body 1Y is charged to a potential of −600 V to −800 V by the charging roll 2Y.

The photosensitive body 1Y is formed by laminating a photosensitive layer on a conductive (for example, volume resistivity at 20° C.: $1\times10^{-6}$ Ωcm or less) base body. This photosensitive layer generally has high resistance (resistance of general resin), but has the property that the specific resistance of the portion irradiated with the laser beam changes when the laser beam 3Y is irradiated. Therefore, the laser beam 3Y is output to the surface of the charged photosensitive body 1Y through the exposure device 3 in accordance with the image data for yellow sent from the control unit (not shown). The laser beam 3Y is applied to the photosensitive layer on the surface of the photosensitive body 1Y, and thereby, an electrostatic charge image of a yellow image pattern is formed on the surface of the photosensitive body 1Y.

The electrostatic charge image is an image formed on the surface of the photosensitive body 1Y by charging, and is a so-called negative latent image formed in such a manner that the specific resistance of the irradiated portion of the photosensitive layer is reduced by the laser beam 3Y, and the electric charge charged on the surface of the photosensitive body 1Y flows, and the charge of the portion with which the laser beam 3Y is not irradiated remains.

The electrostatic charge image formed on the photosensitive body 1Y is rotated to a predetermined development position as the photosensitive body 1Y travels. Then, at this development position, the electrostatic charge image on the photosensitive body 1Y is made visible (developed image) as a toner image by the developing machine 4Y.

In the developing machine 4Y, for example, an electrostatic charge image developer containing at least a yellow toner and a carrier is accommodated. The yellow toner is frictionally charged by being stirred inside the developing machine 4Y, and is held on a developer roll (an example of the developer holding body) with a charge of the same polarity (negative polarity) as the charged electric charge on the photosensitive body 1Y. Then, as the surface of the photosensitive body 1Y passes through the developing machine 4Y, the yellow toner is electrostatically attached to a latent image portion on the surface of the photosensitive body 1Y, and the latent image is developed by the yellow toner. The photosensitive body 1Y on which a yellow toner image is formed is subsequently traveled at a predetermined speed, and the toner image developed on the photosensitive body 1Y is transported to a predetermined first transfer position.

When the yellow toner image on the photosensitive body 1Y is transported to the first transfer position, the first transfer bias is applied to the first transfer roll 5Y, the electrostatic force from the photosensitive body 1Y toward the first transfer roll 5Y acts on the toner image, and the toner image on the photosensitive body 1Y is transferred onto the intermediate transfer belt 20. The transfer bias applied at this time is (+) polarity opposite to polarity (−) of the toner, and for example, in the first unit 10Y, it is controlled to +10 μA by the control unit (not shown).

On the other hand, the toner remaining on the photosensitive body 1Y is removed and collected by a photosensitive body cleaning device 6Y.

Further, the first transfer bias applied to the first transfer rolls 5M, 5C, and 5K after a second unit 10M is also controlled according to the first unit.

In this way, the intermediate transfer belt 20 to which the yellow toner image is transferred in the first unit 10Y is sequentially transported through the second to fourth units 10M, 10C, and 10K, and the toner images of the respective colors are superimposed and transferred in multiples.

The intermediate transfer belt 20 on which toner images of four colors are multiply transferred through the first to fourth units leads to a second transfer portion including the intermediate transfer belt 20 and the support roll 24 in contact with the inner surface of the intermediate transfer belt and a second transfer roll (an example of a second transfer unit) 26 disposed on the image holding surface side of the intermediate transfer belt 20. On the other hand, the recording sheet (an example of the recording medium) P is fed at a predetermined timing to the gap where the second transfer roll 26 and the intermediate transfer belt 20 are in contact with each other via a supply mechanism, and the second transfer bias is applied to the support roll 24. The transfer bias applied at this time is the same polarity (−) as the polarity (−) of the toner, and the electrostatic force from the intermediate transfer belt 20 to the recording sheet P acts on the toner image such that the toner image on the intermediate transfer belt 20 is transferred onto the recording sheet P. The second transfer bias at this time is determined according to the resistance detected by the resistance detection unit (not shown) that detects the resistance of the second transfer portion, and is voltage controlled.

Thereafter, the recording sheet P is sent to the press-contact portion (nip portion) of a pair of fixing rolls in the fixing device (an example of the fixing unit) 28, the toner image is fixed on the recording sheet P, and a fixed image is formed.

Examples of the recording sheet P to which the toner image is transferred include plain paper used for an electrophotographic copying machine and a printer. As the recording medium, in addition to the recording sheet P, an OHP sheet or the like may be mentioned.

In order to further improve the smoothness of the image surface after fixation, the surface of the recording sheet P is also preferably smooth, for example, coated paper in which the surface of plain paper is coated with resin or the like and art paper for printing are preferably used.

The recording sheet P for which the fixing of the color image is completed is transported toward an ejection section, and the series of color image forming operations is completed.

Process Cartridge and Toner Cartridge

A process cartridge according to the exemplar) embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer as a toner image, and is detachable from an image forming apparatus.

The process cartridge according to the exemplary embodiment is not limited to the above-described configuration, and may include a developing machine and at least one selected from other units such as an image holding member, a charging unit, an electrostatic charge image forming unit, and a transfer unit if necessary.

Hereinafter, an example of the process cartridge according to this exemplary embodiment will be described. However, the process cartridge is not limited thereto. Major parts shown in the drawing will be described while descriptions of other parts will be omitted.

Figure 2:
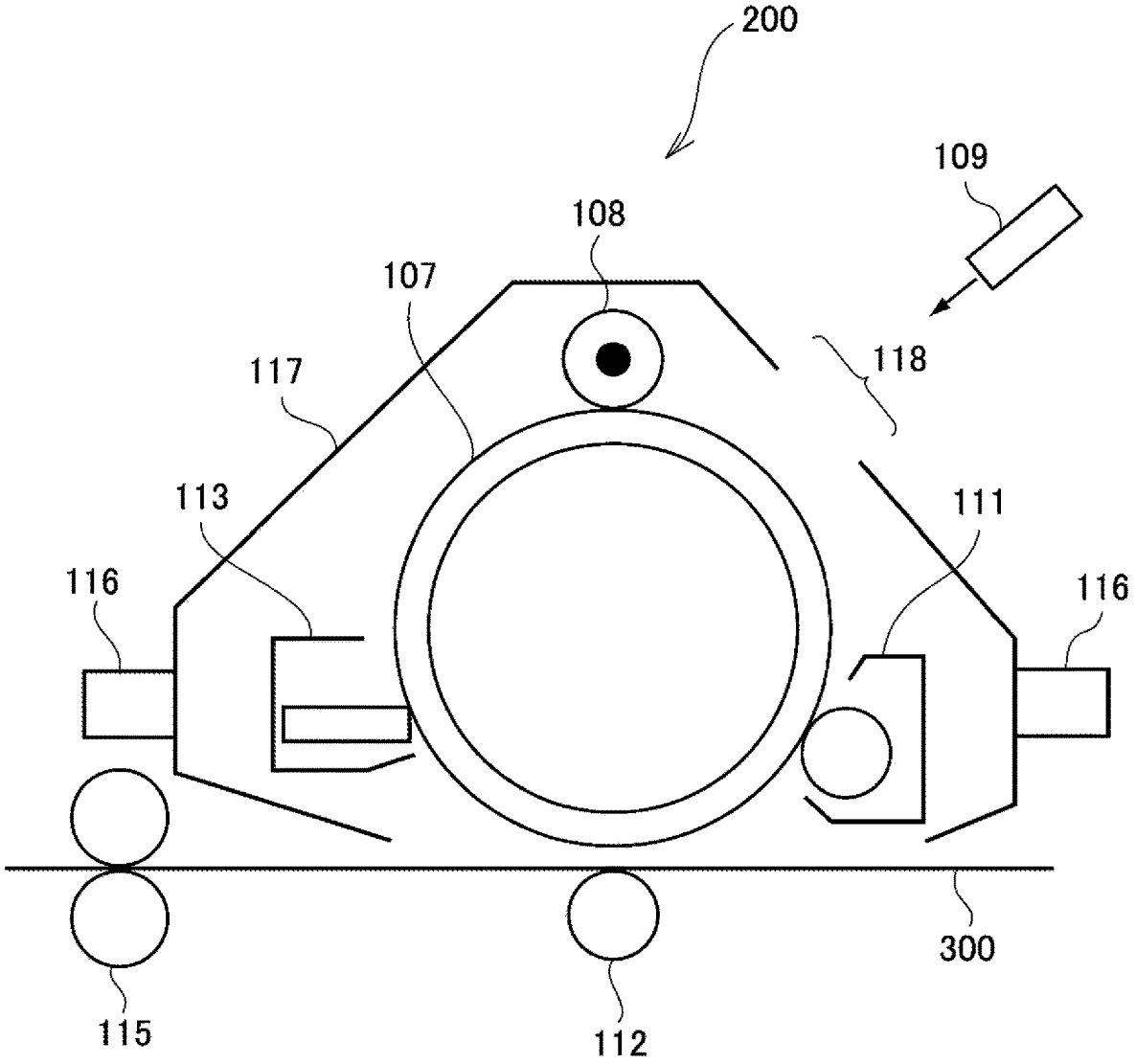
FIG. 2 is a schematic configuration diagram illustrating an example of a process cartridge which is detachable from the image forming apparatus according to this exemplary embodiment.

FIG. 2 is a schematic configuration diagram illustrating the process cartridge according to this exemplary embodiment.

The process cartridge 200 illustrated in FIG. 2 is configured such that a photosensitive body 107 (an example of the image holding member), a charging roll 108 (an example of the charging unit) which is provided in the vicinity of the photosensitive body 107, a developing machine 111 (an example of the developing unit), and a photosensitive body cleaning device 113 (an example of the cleaning unit) are integrally formed in combination, and are held by a housing 117 which is provided with an attached rail 116 and an opening portion 118 for exposing light.

Note that, in FIG. 2, reference numeral 109 is denoted as an exposure device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, the toner cartridge of the exemplary embodiment will be described.

The toner cartridge according to the exemplary embodiment accommodates the toner according to the exemplary embodiment and is detachable from an image forming apparatus.

The toner cartridge contains the toner for replenishment for being supplied to the developing unit provided in the image forming apparatus.

The image forming apparatus as illustrated in FIG. 1 has such a configuration that the toner cartridges 8Y, 8M, 8C, and 8K are detachable therefrom, and the developing machines 4Y, 4M, 4C, and 4K are connected to the toner cartridges corresponding to the respective developing machines (colors) via toner supply tubes (not shown), respectively. In addition, in a case where the toner accommodated in the toner cartridge runs low, the toner cartridge is replaced.

EXAMPLES

Hereinafter, the exemplary embodiments of the disclosure will be described in detail with reference to examples, but the exemplary embodiments of the disclosure are not limited to these examples. In addition, "parts" is by weight in the examples below unless otherwise specified.

Example A

Example A1

Preparation of Amorphous Polyester Resin Dispersion (A1)

Terephthalic acid: 70 parts
Fumaric acid: 30 parts
Ethylene glycol: 45 parts
1,5-pentanediol: 46 parts The above-described materials are put into a flask which has five liters of content, and equipped with a stirrer, a nitrogen inlet pipe, a temperature sensor, and a rectification column, the temperature of the flask is raised up to 220° C. for one hour under nitrogen gas flow, and then 1 part of titanium tetraethoxide is added to total 100 parts of the above materials. While distilling off water to be generated, the temperature is raised up to 240° C. for 0.5 hours, dehydration condensation reaction is continued for one hour at the aforementioned temperature, and then a reaction result is cooled. In this way, a polyester resin having a weight average molecular weight of 9500, a glass transition temperature of 62° C., and an SP value of 10.2 is synthesized.

40 parts of ethyl acetate and 25 parts of 2-butanol are put into a container provided with a temperature control unit and a nitrogen replacement unit so as to prepare a mixed solvent, then 100 parts of polyester resin is slowly put into the container and dissolved, and 10% by weight of ammonia aqueous solution (equivalent to three times the molar ratio with respect to the acid value of the resin) is put into the container and stirred for 30 minutes. Subsequently, the interior of the container is replaced with dry nitrogen, 400 parts of ion exchange water is added dropwise at a rate of 2 parts per minute while maintaining the temperature at 40° C. and stirring the mixed solution so as to perform emulsification. After completion of adding dropwise, the emulsion is returned to 25° C. to obtain a resin particle dispersion in which resin particles having a volume average particle diameter of 200 nm are dispersed. The ion exchange water is added to the resin particle dispersion so as to adjust the solid content to be 20% by weight, and thereby an amorphous polyester resin dispersion (A1) is obtained.

Preparation of Crystalline Polyester Resin Dispersion (A1)

1,10-decanedicarboxylic acid: 98 parts

Sodium dimethyl isophthalate-5-sulfonate: 24 parts 1,9-nonanediol: 100 parts by mol Dibutyltin oxide (catalyst): 0.3 parts After putting the above components into a heat-dried three-necked flask, the air in the container is set as an inert atmosphere with nitrogen gas by a depressurization operation, and stirred and refluxed at 180° C. for five hours with mechanical stirring. Thereafter, the temperature is gradually raised to 230° C. under reduced pressure, and the mixture is stirred for two hours. When it becomes in a viscous state, it is air-cooled, the reaction is stopped, and thereby a crystalline polyester resin A1 (specific crystalline polyester resin) is obtained. In the molecular weight measurement (polystyrene conversion), the obtained "crystalline polyester resin A1" has a weight average molecular weight (Mw) of 9700, a melting temperature of 78° C., and an SP value of 9.3.

90 parts by weight of the obtained crystalline polyester resin A1, 1.8 parts by weight of ionic surfactant Neogen RK (Daiichi Kogyo Seiyaku Co., Ltd.), and 210 parts by weight of ion exchanged water are heated at 100° C., and then, after dispersion with Ultra Turrax T50 manufactured by IKA, a dispersion treatment is performed with a pressure discharge type gorin homogenizer for 1 hour to obtain a crystalline polyester resin dispersion (A1) having a volume average particle diameter of 200 nm and a solid content of 20 parts by weight.

Preparation of Release Agent Particle Dispersion A1

Paraffin wax (HNP-9, produced by Nippon Seiro Co., Ltd.): 100 parts

Anionic surfactant (NEOGEN RK, produced by Daiichi Kogyo Seiyaku Co., Ltd.): 1 part Ion exchanged water: 350 parts The above-described materials are mixed with each other, the mixture is heated at 100° C., is dispersed by using a homogenizer (Ultra-Turrax T50, manufactured by IKA Ltd.), and then is subjected to a dispersing treatment by using Manton-Gaulin high pressure homogenizer (manufactured by Manton Gaulin Mfg Co., Inc.), thereby obtaining a release agent particle dispersion A1 (solid content 20% by weight) in which release agent particles having a volume average particle diameter of 200 nm are dispersed.

Preparation of Black Colored Particle Dispersion A1

Carbon black (produced by Cabot, Regal 330): 50 parts

Anionic surfactant (NEOGEN RK, produced by Daiichi Kogyo Seiyaku Co., Ltd.): 5 parts Ion exchanged water: 192.9 parts The above components are mixed and treated with an Ultimaizer (manufactured by Sugino Machine Co., Ltd.) at 240 MPa for 10 minutes to prepare a black colored particle dispersion A1 (solid content concentration: 20% by weight).

Preparation of Toner Particles (A1)

Ion exchanged water: 200 parts

Amorphous polyester resin dispersion (A1): 150 parts

Crystalline polyester resin dispersion (A1): 10 parts

Black colored particle dispersion A1: 15 parts

Release agent particle dispersion A1: 10 parts

Anionic surfactant (TaycaPower): 2.8 parts

The above materials are put into a round stainless steel flask 0.1 N of nitric acid is added to adjust pH to 3.5, and then a PAC aqueous solution in which 2.0 parts of polyaluminum chloride (PAC, manufactured by Oji Paper Co., Ltd.: 30% powder product) is dissolved in 30 parts of ion exchanged water is added. The mixture is dispersed at 30° C. by using a homogenizer (Ultra-Turrax T50, manufactured by IKA Ltd.), and then is heated at 45° C. in the oil bath for heating, and kept until the volume average particle diameter become 4.8 μm. Thereafter, 60 parts of an amorphous polyester resin particle dispersion (A1) is added and kept for 30 minutes. Thereafter, when the volume average particle diameter reaches 5.2 μm, 60 parts of an amorphous polyester resin particle dispersion (A1) is further added and kept for 30 minutes. Subsequently, after adding 20 parts of 10 weight % NTA (nitrilotriacetic acid) metal salt aqueous solution (Kyrest 70: manufactured by Chelest Corporation), pH is adjusted to 9.0 using 1 N of sodium hydroxide aqueous solution. After that, 1.0 part of an anionic activator (TaycaPower) is put and heated to 85° C. while continuously stirring, and kept for 5 hours. Thereafter, the mixture is cooled to 20° C. at a rate of 20° C./min, filtered, sufficiently washed with ion exchanged water, and dried to obtain toner particles (A1) having a volume average particle diameter of 6.0 μm.

Preparation of Specific Silica Particle (A-A)

Granulation Step for Silica Particles

In a glass reaction vessel equipped with a stirrer, a dropping nozzle, and a thermometer, 420 parts of methanol and 74 parts of 10% by weight ammonia water are added and mixed to obtain an alkali catalyst solution. After adjusting the alkali catalyst solution to 30° C., 180 parts of tetramethoxysilane (TMOS) and 52 parts of 8% by weight ammonia water are dropped while stirring the alkali catalyst solution to obtain a silica particle dispersion. TMOS and 8% by weight ammonia water are added dropwise at the same time, and the entire amount is added dropwise for 10 minutes. Next, the silica particle dispersion is concentrated to a solid content concentration of 40% by weight using a rotary filter (R-Fine manufactured by Kotobuki Kogyou Co., Ltd.). The silica particle dispersion after concentration is designated as a silica particle dispersion (A1).

Silica Particle Surface Treatment Step 100 parts of hexamethyl disilazane (HMDS) is added as a hydrophobization treating agent to 250 parts of the silica particle dispersion (A1), heated to 160° C., and reacted for 2 hours. Next, the silica particle dispersion after the reaction is dried by spray drying to obtain specific silica particles (A-A).

Preparation of Toner (A1)

With respect to 100 parts by weight of the obtained toner particles (A1), 1.10 parts by weight of the obtained specific silica particles (A-A) and 2.8 parts by weight of hydrophobic silica (other silica particles, manufactured by Nippon Aerosil Co., Ltd., RY50, BET specific surface area: 20 $m^2/g$), and 0.05 parts by weight of tetrakistrimethyl siloxysilane (low molecular siloxane, manufactured by Tokyo Chemical Industry Co., Ltd., T3494) are put into a sample mill and mixed at 10,000 rpm for 30 seconds. Thereafter, the toner (A1) is prepared by sieving with a vibrating sieve having a mesh size of 45 μm. The volume average particle diameter of the obtained toner (A1) is 6.0 μm.

The content of the low molecular siloxane in the toner (A1) is 3.8 ppm with respect to the total weight of the toner.

Table 1 indicates the average primary particle diameter ("particle diameter" in Table 1) and the BET specific surface area ("BET" in Table 1) of the specific silica particles (A-A).

Table 1 indicates the $\Delta H2/\Delta H1$ value, the coverage ratio of the external additive ("coverage ratio" in Table 1), and the fluidity index in the obtained toner (A1).

The average primary particle diameter of the specific silica particles is measured as follows.

Observation (50000 times) is performed 100 views with a scanning electron microscope (SEM: S-4700 type manufactured by Hitachi, Ltd.) to set each external additive (in a case of composite external addition, mapping is performed at an acceleration voltage of 20 kV by using an energy dispersive X-ray analyzer EMAX model 6923H (manufactured by Horiba, Ltd.) attached to the electron microscope S4100, and the particle diameter (average value of major axis and minor axis: obtained by approximating a circle) of circular particles corresponding to the image area of the external additive whose external additive type is determined at 1000 locations, and the average value is "average primary particle diameter of specific silica particles").

Example A2

Toner particles (A2) are obtained in the same manner as in Example A1 except that in the preparation of the toner particles (A1), instead of cooling to 20° C. at a rate of 20° C./min, the mixture is cooled to 60° C. at a rate of 20° C./min and kept for 30 minutes, followed by cooling to 20° C. at a rate of 10° C./min.

A toner (A2) of Example A2 is obtained in the same manner as the toner (A1) of Example A1, except that the toner particles (A2) is used instead of the toner particles (A1).

Table 1 indicates the ΔH2/ΔH1 value, the coverage ratio of the external additive ("coverage ratio" in Table 1), and the fluidity index in the toner (A2).

Example A3

Toner particles (A3) are obtained in the same manner as in Example A1 except that in the preparation of the toner particles (A1), instead of cooling to 20° C. at a rate of 20° C./min, the mixture is cooled to 20° C. at a rate of 30° C./min.

A toner (A3) of Example A3 is obtained in the same manner as the toner (A1) of Example A1, except that the toner particles (A3) is used instead of the toner particles (A1).

Table 1 indicates the ΔH2/ΔH1 value, the coverage ratio of the external additive ("coverage ratio" in Table 1), and the fluidity index in the toner (A3).

Examples A4 to A6

Toners (A4) to (A6) of Examples A4 to A6 are obtained in the same manner as the toner (A1) of Example A1 except that instead of using 1.10 part by weight of the specific silica particles A-A, the specific silica particles of the kinds indicated in Table 1 in the addition amount indicated in Table 1 ("amount" in Table 1, unit is parts by weight) is used as the specific silica particles.

The content of the low molecular siloxane in the toner (A4) is 3.9 ppm with respect to the total weight of the toner.

The content of the low molecular siloxane in the toner (A5) is 4.0 ppm with respect to the total weight of the toner.

The content of the low molecular siloxane in the toner (A6) is 3.8 ppm with respect to the total weight of the toner.

Table 1 indicates the ΔH2/ΔH1 value, the coverage ratio of the external additive ("coverage ratio" in Table 1), and the fluidity index in the toner (A4) to toner (A6).

Note that, in Table 1, "A-B" to "A-D" in the kinds of the silica particles respectively indicate the following specific silica particles, and the average primary particle diameter ("particle diameter" in Table 1) and the BET specific surface area ("BET" in Table 1) of the specific silica particles (A-B) to specific silica particles (A-D) are indicated in Table 1.

Preparation of Specific Silica Particles (A-B)

Specific silica particles (A-B) are obtained in the same manner as the specific silica particles (A-A), except that in the preparation of the specific silica particles (A-A), instead of putting 420 parts of methanol and 74 parts of 10% by weight ammonia water, 280 parts of methanol and 68 parts of 10% by weight ammonia water are put, and in the surface treatment step, instead of heating at 160° C. and reacting for 2 hours, heating is performed at 150° C. and the reaction is performed for 2.5 hours.

Preparation of Specific Silica Particles (A-C)

Specific silica particles (A-C) are obtained in the same manner as the specific silica particles (A-A) except that in the preparation of the specific silica particles (A-A), instead of dropping 180 parts of tetramethoxysilane (TMOS) and 52 parts of 8% by weight ammonia water, 120 parts tetramethoxysilane (TMOS) and 64 parts of 8% by weight ammonia water are used, the dropping time is changed from 10 minutes to 12 minutes, and in the surface treatment step, instead of heating to 160° C. and reacting for 2 hours, heating is performed at 150° C. and the reaction is performed for 1.5 hours.

Preparation of Specific Silica Particles (A-D)

Specific silica particles (A-D) are obtained in the same manner as the specific silica particles (A-A) except that in the preparation of the specific silica particles (A-A), instead of dropping 180 parts of tetramethoxysilane (TMOS) and 52 parts of 8% by weight ammonia water, 200 parts of tetramethoxysilane (TMOS) and 48 parts of 8% by weight ammonia water are used, and in the surface treatment step, instead of heating to 160° C. and reacting for 2 hours, heating is performed at 150° C. and the reaction is performed for 2.5 hours.

Example A7

A toner (A7) of Example A7 is obtained in the same manner as the toner (A1) of Example A1, except that in the preparation of the toner (A1), the addition amount ("amount" in Table 1, the unit is part by weight) of the specific silica particles is as indicated in Table 1, the number of stirring of the sample mill among the blending conditions is changed from 10,000 rpm to 8500 rpm, and the stirring time is changed from 30 seconds to 25 seconds.

The content of the low molecular siloxane in the toner (A7) is 2.9 ppm with respect to the total weight of the toner.

Table 1 indicates the ΔH2/ΔH1 value, the coverage ratio of the external additive ("coverage ratio" in Table 1), and the fluidity index in the toner (A7).

Example A8

A toner (A8) of Example A8 is obtained in the same manner as the toner (A1) of Example 1, except that in the preparation of the toner (A1), the addition amount ("amount" in Table 1, the unit is part by weight) of the specific silica particles is as indicated in Table 1, the number of stirring of the sample mill among the blending conditions is changed from 10,000 rpm to 12000 rpm, and the stirring time is changed from 30 seconds to 45 seconds.

The content of the low molecular siloxane in the toner (A8) is 4.2 ppm with respect to the total weight of the toner.

Table 1 indicates the ΔH2/ΔH1 value, the coverage ratio of the external additive ("coverage ratio" in Table 1), and the fluidity index in the toner (A8).

Comparative Example C1

Toner particles (C1) are obtained in the same manner as in Example A1 except that in the preparation of the toner particles (A1), instead of cooling to 20° C. at a rate of 20° C./min, the mixture is cooled to 20° C. at a rate of 35° C./min.

A toner (C1) of Comparative Example C1 is obtained in the same manner as the toner (A1) of Example A1, except that the toner particles (C1) are used instead of the toner particles (A1).

Table 1 indicates the ΔH2/ΔH1 value, the coverage ratio of the external additive ("coverage ratio" in Table 1), and the fluidity index in the toner (C1).

Comparative Example C2

A toner (C2) of Comparative Example C2 is obtained in the same manner as the toner (A1) of Example A1 except that instead of using 1.10 part by weight of the specific silica particles (A-A), the specific silica particles of the kinds indicated in Table 1 in the addition amount indicated in Table 1 ("amount" in Table 1, unit is parts by weight) is used.

The content of the low molecular siloxane in the toner (C2) is 3.8 ppm with respect to the total weight of the toner.

Table 1 indicates the ΔH2/ΔH1 value, the coverage ratio of the external additive ("coverage ratio" in Table 1), and the fluidity index in the toner (C2).

Note that, in Table 1, "A-E" in the kinds of the silica particles respectively indicate the following silica particles, and the average primary particle diameter ("particle diameter" in Table 1) and the BET specific surface area ("BET" in Table 1) of the silica particles (A-E) are indicated in Table 1.

Preparation of Silica Particles (A-E)

Silica particles (A-E) are obtained in the same manner as the specific silica particles (A-A) except that in the preparation of the specific silica particles (A-A), instead of putting 420 parts of methanol and 74 parts of 10% by weight ammonia water, 275 parts of methanol and 68 parts of 10% by weight ammonia water is put, and instead of dropping 180 parts of tetramethoxysilane (TMOS) and 52 parts of 8% by weight ammonia water, 195 parts of tetramethoxysilane (TMOS) and 50 parts of 8% by weight ammonia water are used, and in the surface treatment step, instead of heating to 160° C. and reacting for 2 hours, heating is performed at 150° C. and the reaction is performed for 3.0 hours.

Preparation of Carrier

Ferrite particles (volume average particle diameter: 50 μm): 100 parts

Toluene: 14 parts

Styrene-methyl methacrylate copolymer: 2 parts (Component ratio: 90/10, Mw=80000)

Carbon black (R 330 manufactured by Cabot): 0.2 parts

First, the above components excluding ferrite particles are stirred with a stirrer for 10 minutes to prepare a dispersed coating solution, and then this coating solution and ferrite particles are put into a vacuum degassing type kneader, stirred at 60° C. for 30 minutes, and degassed by further depressurization while being heated, and the resultant is dried to obtain a carrier.

Preparation of Developer

Each obtained toner and carrier are put in a V blender at a ratio of toner:carrier=5:95 (weight ratio) and stirred for 20 minutes to obtain each developer.

Evaluation

Evaluation of toner residue and external additive adhesion in cartridge

The toner residue ("residue" in Table 1) and external additive adhesion ("adhesion" in Table 1) in the cartridge are evaluated by the following methods and criteria. The results are indicated in Table 1.

A transparent toner cartridge made of PET (polyethylene terephthalate) is filled with 310 g of the toner to be evaluated, and seasoned (leaved) for 17 hours in an environment at 28° C. and 85%.

Thereafter, the toner cartridge is mounted in a replenish apparatus (a replenish apparatus that replenishes a toner from the toner cartridge to a toner container) having a transport nozzle in an environment of 22° C. and 15%. The rotation of the toner container and the operation of the replenish apparatus are performed for 50 minutes, the toner in the toner cartridge is discharged from the toner cartridge, and the weight of the discharged toner is measured to confirm the remaining amount of toner in the cartridge (evaluation of toner remaining in the cartridge).

Thereafter, the toner cartridge is gently tilted to discharge the toner staying at the bottom of the toner cartridge, and the adhesion of the external additive to the wall surface inside the toner cartridge is checked (evaluation of adhesion of external additive in the cartridge).

The conditions for the rotation of the toner container and the operation of the replenish apparatus are as follows.

Number of revolutions of toner container: 30 rpm

Transport nozzle length of replenish apparatus: 70 mm

Screw pitch in the transport path: 12.5 mm

Transport screw outer diameter: 10 mm

Transport screw shaft diameter: 4 mm

Number of revolutions of transport screw: 62.4 rpm

The evaluation criteria for evaluating the toner remaining in the cartridge are as follows.

G1: The remaining amount of toner in the cartridge is less than 25 g (no problem in actual use)

G2: The remaining amount of toner in the cartridge is 25 g or more and less than 50 g (no problem in actual use)

G3: The remaining amount of toner in the cartridge is 50 g or more (there is a problem in actual use)

The evaluation criteria for the evaluation of adhesion of the external additive in the cartridge are as follows.

G1: There is no external additive attached to the wall and it is not whitened

G2: The external additive is slightly attached to the wall surface and whitened, but there is no problem in actual use.

G3: The external additive is attached to the wall surface and is whitened as a whole, which is a problem in actual use.

Evaluation of External Additive Detachability

The external additive detachability ("detachment" in Table 1) from the toner particles is evaluated by the following method and criteria. The results are indicated in Table 1.

First, 100 ml of ion exchanged water and 5.5 ml of 10% by weight octylphenol ethoxylate (Triton X100 aqueous solution (manufactured by Acros Organics)) are added to a 200 ml glass bottle, and 5 g of the toner to be evaluated is added to the mixed solution, stirred 30 times, and allowed to stand for more than 1 hour.

Then, after stirring the above mixed solution 20 times, using an ultrasonic homogenizer (manufactured by SONICS & MATERIALS Co., Ltd., product name homogenizer, model VCX750, CV33), a dial is set at an output of 30%, and ultrasonic energy is applied for 1 minute under the following conditions.

Vibration time: 60 seconds continuous

Amplitude: Set to 20 W (30%)

Vibration start temperature: 40±1.5° C.

Distance between ultrasonic transducer and bottom of container: 10 mm

Next, the mixed solution to which ultrasonic energy is applied is suction filtered using a filter paper [trade name: qualitative filter paper (No. 2, 110 mm), manufactured by Advantech Toyo Co., Ltd.], and washed again with ion exchanged water twice, free particles are removed by filtration, and then the toner is dried.

The amount of particles remaining (hereinafter, referred to as amount of particles after dispersion) in the toner after removal of the particles by the above treatment and the amount of toner particles (hereinafter, referred to as the amount of particles before dispersion) not subjected to the treatment for removing the above particles are determined by the fluorescent X-ray method, and the values of the amount of particles before dispersion and the amount of particles after dispersion are substituted into the following expression.

The value calculated by the following expression is defined as a particle detachment rate.

Particle detachment rate (% by weight)=[(particle amount before dispersion−particle amount after dispersion)/particle amount before dispersion]×100 Expression:

Evaluation criteria for the detachability evaluation are as follows.

G1: Detachment rate is less than 30% (no problem in actual use)

G2: Detachment rate is 30% or more and less than 50% (no problem in actual use)

G3: Detachment rate is 50% or more (problems in actual use)

TABLE 1

| | ΔH2/ΔH1 | Silica particle | | | | Coverage ratio | Fluidity | Evaluation | | |
|---|---|---|---|---|---|---|---|---|---|---|
| | value | Kinds | Particle diameter (nm) | BET ($m^2/g$) | Amount | (%) | index | Remaining | Attachment | Detachment |
| Example A1 | 0.70 | A-A | 64 | 137 | 1.10 | 85 | 17 | G1 | G1 | G1 |
| Example A2 | 0.40 | A-A | 64 | 137 | 1.10 | 85 | 17 | G2 | G2 | G1 |
| Example A3 | 0.92 | A-A | 64 | 137 | 1.10 | 85 | 17 | G2 | G2 | G2 |
| Example A4 | 0.70 | A-B | 64 | 105 | 1.10 | 85 | 17 | G2 | G2 | G1 |
| Example A5 | 0.70 | A-C | 35 | 160 | 0.94 | 85 | 17 | G1 | G2 | G1 |
| Example A6 | 0.70 | A-D | 75 | 110 | 2.01 | 85 | 17 | G2 | G1 | G2 |
| Example A7 | 0.70 | A-A | 64 | 137 | 1.01 | 82 | 17 | G2 | G2 | G1 |
| Example A8 | 0.70 | A-A | 64 | 137 | 1.50 | 85 | 20 | G2 | G2 | G1 |
| Comparative Example C1 | 0.96 | A-A | 64 | 137 | 1.10 | 85 | 17 | G3 | G3 | G3 |
| Comparative Example C2 | 0.70 | A-E | 70 | 80 | 1.10 | 85 | 17 | G3 | G3 | G3 |

From the results in Table 1, it can be seen that in this example, the detachment of the external additive is prevented as compared with the comparative examples. Further, in this example, it can be seen that, as compared with the comparative examples, when the environment changes from high temperature and high humidity to low temperature and low humidity, the attachment of the external additive to the wall surface in the cartridge is prevented.

Example D

Example D1

Preparation of Amorphous Polyester Resin Dispersion (D1)

Terephthalic acid: 70 parts

Fumaric acid: 30 parts

Ethylene glycol: 45 parts 1,5-pentanediol: 46 parts

The above-described materials are put into a flask which has five liters of content, and equipped with a stirrer, a nitrogen inlet pipe, a temperature sensor, and a rectification column, the temperature of the flask is raised up to 220° C. for one hour under nitrogen gas flow, and then 1 part of titanium tetraethoxide is added to total 100 parts of the above materials. While distilling off water to be generated, the temperature is raised up to 240° C. for 0.5 hours, dehydration condensation reaction is continued for one hour at the aforementioned temperature, and then a reaction result is cooled. In this way, a polyester resin having a weight average molecular weight of 9500, a glass transition temperature of 62° C., and an SP value of 10.2 is synthesized.

40 parts of ethyl acetate and 25 parts of 2-butanol are put into a container provided with a temperature control unit and a nitrogen replacement unit so as to prepare a mixed solvent, then 100 parts of polyester resin is slowly put into the container and dissolved, and 10% by weight of ammonia aqueous solution (equivalent to three times the molar ratio with respect to the acid value of the resin) is put the container and stirred for 30 minutes.

Subsequently, the interior of the container is replaced with dry nitrogen, 400 parts of ion exchange water is added dropwise at a rate of 2 parts per minute while maintaining the temperature at 40° C. and stirring the mixed solution so as to perform emulsification. After completion of adding dropwise, the emulsion is returned to 25° C. to obtain a resin particle dispersion in which resin particles having a volume average particle diameter of 200 nm are dispersed. The ion exchange water is added to the resin particle dispersion so as to adjust the solid content to be 20% by weight, and thereby an amorphous polyester resin dispersion (D1) is obtained.

Preparation of Crystalline Polyester Resin Dispersion (D1)

Dimethyl sebacate: 98 parts

Sodium dimethyl isophthalate-5-sulfonate: 20 parts 1,5-pentanediol: 100 parts

Dibutyltin oxide (catalyst): 0.3 parts

After putting the above components into a heat-dried three-necked flask, the air in the container is set as an inert atmosphere with nitrogen gas by a depressurization operation, and stirred and refluxed at 180° C. for five hours with mechanical stirring. Thereafter, the temperature is gradually raised to 230° C. under reduced pressure, and the mixture is stirred for two hours. When it becomes in a viscous state, it is air-cooled, the reaction is stopped, and thereby a crystalline polyester resin D1 (specific crystalline polyester resin) is obtained. In the molecular weight measurement (polystyrene conversion), the obtained "crystalline polyester resin D1" has a weight average molecular weight (Mw) of 9700, a melting temperature of 84° C. and an SP value of 9.3.

90 parts by weight of the obtained crystalline polyester resin D1, 1.8 parts by weight of ionic surfactant Neogen RK (Daiichi Kogyo Seiyaku Co., Ltd.), and 210 parts by weight of ion exchanged water are heated at 100° C., and then, after dispersion with Ultra Turrax T50 manufactured by IKA, a dispersion treatment is performed with a pressure discharge type Gorin homogenizer for 1 hour to obtain a crystalline polyester resin dispersion (D1) having a volume average particle diameter of 200 nm and a solid content of 20 parts by weight.

Preparation of Release Agent Particle Dispersion D1

Paraffin wax (HNP-9, produced by Nippon Seiro Co., Ltd.): 100 parts

Anionic surfactant (NEOGEN RK, produced by Daiichi Kogyo Seiyaku Co., Ltd.): 1 part Ion exchanged water: 350 parts The above-described materials are mixed with each other, the mixture is heated at 100° C., is dispersed by using a homogenizer (Ultra-Turrax T50, manufactured by IKA Ltd.), and then is subjected to a dispersing treatment by using Manton-Gaulin high pressure homogenizer (manufactured by Manton Gaulin Mfg Co., Inc.), thereby obtaining a release agent particle dispersion D (solid content 20% by weight) in which release agent particles having a volume average particle diameter of 200 nm are dispersed.

Preparation of black colored particle dispersion D1

Carbon black (Regal 330 produced by Cabot): 50 parts

Anionic surfactant (NEOGEN RK, produced by Daiichi Kogyo Seiyaku Co., Ltd.): 5 parts Ion exchanged water: 192.9 parts The above components are mixed and treated with an Ultimaizer (manufactured by Sugino Machine Co., Ltd.) at 240 MPa for 10 minutes to prepare a black colored particle dispersion D1 (solid content concentration: 20% by weight).

Preparation of Toner Particles (D1)

Ion exchanged water: 200 parts by weight

Amorphous polyester resin dispersion (D1): 150 parts

Crystalline polyester resin dispersion (D1): 10 parts

Black colored particle dispersion D1: 15 parts

Release agent particle dispersion D1: 10 parts

Anionic surfactant (TaycaPower): 2.8 parts

Tetrakistrimethylsiloxysilane: 0.5 parts by weight (manufactured by Tokyo Kasei Co., Ltd., T3494)

The above materials are put into a round stainless steel flask, 0.1 N of nitric acid is added to adjust pH to 3.5, and then a PAC aqueous solution in which 2.0 parts of polyaluminum chloride (PAC, manufactured by Oji Paper Co., Ltd.: 30% powder product) is dissolved in 30 parts of ion exchanged water is added. The mixture is dispersed at 30° C. by using a homogenizer (Ultra-Turrax T50, manufactured by IKA Ltd.), and then is heated to 45° C. in the oil bath for heating, and kept until the volume average particle diameter become 4.8 μm. Thereafter, 60 parts of an amorphous polyester resin particle dispersion (D1) is added and kept for 30 minutes. Thereafter, when the volume average particle diameter reaches 5.2 μm, 60 parts of an amorphous polyester resin particle dispersion (D1) is further added and kept for 30 minutes. Subsequently, after adding 20 parts of 10 weight % NTA (nitrilotriacetic acid) metal salt aqueous solution (Kyrest 70: produced by Chelest Corporation), pH is adjusted to 9.0 using 1 N of sodium hydroxide aqueous solution. After that, 1.0 part of an anionic activator (Tayca-Power) is put and heated to 85° C. while continuously stirring, and kept for 5 hours. Thereafter, the mixture is cooled to 60° C. at a rate of 20° C./min and kept for 30 minutes, then cooled to 20° C. at a rate of 10° C./min, filtered, sufficiently washed with ion exchanged water, and dried to obtain toner particles (D1) having a volume average particle diameter of 6.0 μm.

Preparation of Specific Silica Particles (D-A)

Granulation step for silica particles

In a glass reaction vessel equipped with a stirrer, a dropping nozzle, and a thermometer, 400 parts of methanol and 74 parts of 10% by weight ammonia water are added and mixed to obtain an alkali catalyst solution. After adjusting the alkali catalyst solution to 30° C., 155 parts of tetramethoxysilane (TMOS) and 50 parts of 8% by weight ammonia water are dropped while stirring the alkali catalyst solution to obtain a silica particle dispersion. TMOS and 8% by weight ammonia water are added dropwise at the same time, and the entire amount is added dropwise for 10 minutes. Next, the silica particle dispersion is concentrated to a solid content concentration of 40% by weight using a rotary filter (R-Fine manufactured by Kotobuki Kogyou Co., Ltd.). The silica particle dispersion after concentration is designated as a silica particle dispersion (D1).

Silica Particle Surface Treatment Step 100 parts of hexamethyl disilazane (HMDS) is added as a hydrophobization treating agent to 250 parts of the silica particle dispersion (D1), heated to 155° C., and reacted for 2 hours. Next, the silica particle dispersion after the reaction is dried by spray drying to obtain specific silica particles (D-A).

Preparation of Toner (D1)

With respect to 100 parts by weight of the obtained toner particles (D1), 1.50 parts by weight of the specific silica particles (D-A), and 1.50 parts by weight of hydrophobic silica (other silica particles, produced by Nippon Aerosil Co., Ltd., RY50, BET specific surface area: 20 $m^2/g$) are mixed at 10,000 rpm for 30 seconds using a sample mill. Thereafter, the toner (D1) is prepared by sieving with a vibrating sieve having a mesh size of 45 μm. The volume average particle diameter of the obtained toner (D1) is 6.0 μm.

The content of the low molecular siloxane in the toner (D1) is 0.5 ppm with respect to the total weight of the toner.

Table 2 indicates the average primary particle diameter ("particle diameter" in Table 2) and the BET specific surface area ("BET" in Table 2) of the specific silica particles (silica D-A).

Table 2 indicates the $\Delta H2/\Delta H1$ value, the coverage ratio of the external additive ("coverage ratio" in Table 2), and the fluidity index in the obtained toner (D1).

The average primary particle diameter of the specific silica particles is measured as follows.

Observation (50000 times) is performed 100 views with a scanning electron microscope (SEM: S-4700 type manufactured by Hitachi, Ltd.) to set each external additive (in a case of composite external addition, mapping is performed at an acceleration voltage of 20 kV by using an energy dispersive X-ray analyzer EMAX model 6923H (manufactured by Horiba, Ltd.) attached to the electron microscope S4100, and the particle diameter (average value of major axis and minor axis: obtained by approximating a circle) of circular particles corresponding to the image area of the external additive whose external additive type is determined at 1000 locations, and the average value is "average primary particle diameter of specific silica particles").

Example D2

Toner particles (D2) are obtained in the same manner as in Example D1 except that in the preparation of the toner particles (D1), the amount of tetrakistrimethyl siloxysilane added is changed from 0.5 parts by weight to 1.3 parts by weight, and the mixture is cooled to 70° C. at a rate of 20° C./min instead of cooling to 60° C. at a rate of 20° C./min.

A toner (D2) of Example D2 is obtained in the same manner as the toner (D1) of Example D1, except that the toner particles (D2) are used instead of the toner particles (D1).

The content of the low molecular siloxane in the toner (D2) is 1.3 ppm with respect to the total weight of the toner.

Table 2 indicates the ΔH2/ΔH1 value, the coverage ratio of the external additive ("coverage ratio" in Table 2), and the fluidity index in the toner (D2).

Example D3

Toner particles (D3) are obtained in the same manner as in Example D1 except that in the preparation of the toner particles (D1), the amount of tetrakistrimethyl siloxysilane added is changed from 0.5 parts by weight to 2.2 parts by weight, and the mixture is cooled to 40° C. at a rate of 20° C./min instead of cooling to 60° C. at a rate of 20° C./min.

A toner (D3) of Example D3 is obtained in the same manner as the toner (D1) of Example D1, except that the toner particles (D3) are used instead of the toner particles (D1).

The content of the low molecular siloxane in the toner (D3) is 2.2 ppm with respect to the total weight of the toner.

Table 2 indicates the ΔH2/ΔH1 value, the coverage ratio of the external additive ("coverage ratio" in Table 2), and the fluidity index in the toner (D3).

Examples D4 and D5

Toner (D4) and toner (D5) of Examples D4 and Example D5 are obtained in the same manner as the toner (D1) of Example D1 except that instead of using 1.50 parts by weight of the specific silica particles (D-A), the specific silica particles of the kinds indicated in Table 2 in the addition amount indicated below is used as the specific silica particles.

The content of the low molecular siloxane in the toner (D4) is 4.0 ppm with respect to the total weight of the toner.

The content of the low molecular siloxane in the toner (D5) is 2.0 ppm with respect to the total weight of the toner.

Table 2 indicates the ΔH2/ΔH1 value, the coverage ratio of the external additive ("coverage ratio" in Table 2), and the fluidity index in the toner (D4) and toner (D5).

Note that, in Table 2, "D-B" and "D-C" in the kinds of the silica particles respectively indicate the following specific silica particles, and the average primary particle diameter ("particle diameter" in Table 2) and the BET specific surface area ("BET" in Table 2) of the specific silica particles (D-B) to specific silica particles (D-C) are indicated in Table 2.

Specific silica particles (D-B): Specific silica particles added in an amount of 2.5 parts by weight Preparation of Specific Silica Particles (D-B)

Specific silica particles (D-B) are obtained in the same manner as the specific silica particles (D-A) except that in the preparation of the specific silica particles (D-A), instead of dropping 155 parts of tetramethoxysilane (TMOS) and 50 parts of 8% by weight ammonia water, 190 parts tetramethoxysilane (TMOS) and 46 parts of 8% by weight ammonia water are used, and in the surface treatment step, instead of heating to 155° C. and reacting for 2 hours, heating is performed at 145° C. and the reaction is performed for 2.5 hours.

Specific silica particles (D-C): Specific silica particles added in an amount of 1.0 parts by weight Preparation of Hydrophobic Silica Particles (D-C)

Specific silica particles (D-C) are obtained in the same manner as the specific silica particles (D-A) except that in the preparation of the specific silica particles (D-A), instead of dropping 155 parts of tetramethoxysilane (TMOS) and 50 parts of 8% by weight ammonia water, 115 parts tetramethoxysilane (TMOS) and 68 parts of 8% by weight ammonia water are used, the dropping time is changed from 10 minutes to 14 minutes, and in the surface treatment step, instead of heating to 155° C. and reacting for 2 hours, heating is performed at 150° C. and the reaction is performed for 1.5 hours.

Example D6

Toner particles (D6) are obtained in the same manner as in Example D1 except that in the preparation of the toner particles (D1), the amount of tetrakistrimethyl siloxysilane added is changed from 0.5 parts by weight to 6.0 parts by weight, and the mixture is cooled to 20° C. at a rate of 10° C./min after being cooled 70° C. at a rate of 15° C./min and kept for 30 minutes instead of cooling to 20° C. at a rate of 10° C./min after cooling 60° C. at a rate of 20° C./min and keeping for 30 minutes.

Toner (D6) of Example D6 is obtained in the same manner as the toner (D1) of Example D1 except that the toner particles (D6) are used instead of the toner particles (D1), and instead of 1.50 parts by weight of the silica D-A, the specific silica particles of the kinds indicated in Table 2 in the addition amount indicated below is used as the specific silica particles.

The content of the low molecular siloxane in the toner (D6) is 6.0 ppm with respect to the total weight of the toner.

Table 2 indicates the ΔH2/ΔH1 value, the coverage ratio of the external additive ("coverage ratio" in Table 2), and the fluidity index in the toner (D6).

Note that, in Table 2. "D-D" in the kinds of the silica particles respectively indicate the following specific silica particles, and the average primary particle diameter ("particle diameter" in Table 2) and the BET specific surface area ("BET" in Table 2) of the specific silica particles (D-D) are indicated in Table 2.

Specific silica particles (D-D): Specific silica particles added in amount of 2.5 parts by weight Preparation of Silica Particles (D-D)

Specific silica particles (D-D) are obtained in the same manner as the specific silica particles (D-A) except that in the preparation of the specific silica particles (D-A), instead of putting 400 parts of methanol and 74 parts of 10% by weight ammonia water, 320 parts of methanol and 68 parts of 10% by weight ammonia water is put, and instead of dropping 155 parts of tetramethoxysilane (TMOS) and 50 parts of 8% by weight ammonia water, 190 parts tetramethoxysilane (TMOS) and 46 parts of 8% by weight ammonia water are used, and in the surface treatment step, instead of heating to 155° C. and reacting for 2 hours, heating is performed at 150° C. and the reaction is performed for 2.5 hours.

Example D7

Toner particles (D7) are obtained in the same manner as in Example D1 except that in the preparation of the toner particles (D1), the amount of tetrakistrimethyl siloxysilane added is changed from 0.5 parts by weight to 4.0 parts by weight, and the mixture is cooled to 20° C. at a rate of 10° C./min after being cooled 65° C. at a rate of 15° C./min and kept for 30 minutes instead of cooling to 20° C. at a rate of 10° C./min after cooling 60° C. at a rate of 20° C./min and keeping for 30 minutes.

A toner (D7) of Example D7 is obtained in the same manner as the toner (D1) of Example D1, except that the toner particles (D6) are used instead of the toner particles (D1), and the amount of the specific silica particles added is changed to 2.2 parts by weight.

The content of the low molecular siloxane in the toner (D7) is 4.0 ppm with respect to the total weight of the toner.

Table 2 indicates the ΔH2/ΔH1 value, the coverage ratio of the external additive ("coverage ratio" in Table 2), and the fluidity index in the toner (D7).

Comparative Example F1

Toner particles (F1) is obtained in the same manner as in Example D1 except that in the preparation of the toner particles (D1), the amount of tetrakistrimethyl siloxysilane added is changed from 0.5 parts by weight to 4.0 parts by weight, and the mixture is cooled to 20° C. at a rate of 10° C./min after being cooled 50° C. at a rate of 30° C./min and kept for 30 minutes instead of cooling to 20° C. at a rate of 10° C./min after cooling 60° C. at a rate of 20° C./min and keeping for 30 minutes.

A toner (F1) of Comparative Example F1 is obtained in the same manner as the toner (D1) of Example D1, except that the toner particles (F1) are used instead of the toner particles (D1).

The content of the low molecular siloxane in the toner (F1) is 4.0 ppm with respect to the total weight of the toner.

Table 2 indicates the ΔH2/ΔH1 value, the coverage ratio of the external additive ("coverage ratio" in Table 2), and the fluidity index in the toner (F1).

Comparative Example F2

A toner (F2) of Comparative Example F2 is obtained in the same manner as the toner (D1) of Example D1 except that instead of using 1.50 part by weight of the specific silica particles (D-A), the specific silica particles of the kinds indicated in Table 2 in the addition amount indicated below are used.

The content of the low molecular siloxane in the toner (F2) is 4.0 ppm with respect to the total weight of the toner.

Table 2 indicates the ΔH2/ΔH1 value, the coverage ratio of the external additive ("coverage ratio" in Table 2), and the fluidity index in the toner (F2).

Note that, in Table 2. "D-H" in the kinds of the silica particles respectively indicate the following silica particles, and the average primary particle diameter ("particle diameter" in Table 2) and the BET specific surface area ("BET" in Table 2) of the silica particles (D-H) are indicated in Table 2.

Silica particles (D-H): Silica particles added in an amount of 2.0 parts by weight Preparation of Silica Particle (D-H)

Silica particles (D-H) are obtained in the same manner as the specific silica particle (D-A) except that in the preparation of the specific silica particles (D-A), instead of putting 400 parts of methanol and 74 parts of 10% by weight ammonia water, 295 parts of methanol and 72 parts of 10% by weight ammonia water is put, and instead of dropping 155 parts of tetramethoxysilane (TMOS) and 50 parts of 8% by weight ammonia water, 195 parts of tetramethoxysilane (TMOS) and 50 parts of 8% by weight ammonia water are used, and in the surface treatment step, instead of heating to 155° C. and reacting for 2 hours, heating is performed at 145° C. and the reaction is performed for 2.5 hours.

Preparation of Carrier

Ferrite particles (volume average particle diameter: 50 μm): 100 parts

Toluene: 14 parts

Styrene-methyl methacrylate copolymer: 2 parts (Component ratio: 90/10, Mw=80000)

Carbon black (Regal 330 produced by Cabot): 0.2 parts

First, the above components excluding ferrite particles are stirred with a stirrer for 10 minutes to prepare a dispersed coating solution, and then this coating solution and ferrite particles are put into a vacuum degassing type kneader, stirred at 60° C. for 30 minutes, and degassed by further depressurization while being heated, and the resultant is dried to obtain a carrier.

Preparation of Developer

Each obtained toner and carrier are put in a V blender at a ratio of toner:carrier=5:95 (weight ratio) and stirred for 20 minutes to obtain each developer.

Evaluation

Low temperature fixability evaluation

A developing device of an Apeosport 6-C7771 modified machine manufactured by Fuji Xerox Co., Ltd. (a fixing device is modified so that a fixing temperature can be changed) is filled with each developer thus obtained, and a fixing roll surface temperature of the fixing device is changed from 60° C. to 200° C. every 10° C., and a solid portion (toner applied amount: 4.5 g/m$^2$) and a thin line portion are imaged at each temperature. A crease is placed inside the center portion of these solid portion fixed images, and the destruction of the fixed image is visually evaluated. Then, the fixing temperature at which there is no problem is set as the minimum fixing temperature (MTF (° C.)) to perform evaluation based on the following criteria. The results are indicated in Table 2.

Evaluation criteria for low temperature fixability

G1: MTF≤110° C. Excellent low temperature fixability

G2: 110° C.<MTF≤120° C. Fixability with no problem in actual use

G3: 120° C.<MTF Fixability with problem in actual use

Transferability Evaluation

Using a modified DocuCentreColor400 (manufactured by Fuji Xerox Co., Ltd.) in an environment with a temperature of 28° C. and a humidity of 85%, an image sample with rectangular patch written so that the image density is 1% is output to embossed paper (LEATHAC 66, 203 gsm, manufactured by Tokushu Tokai Paper Co., Ltd.), and then image quality evaluation (checking presence and absence of white spot) is performed. In a case where the obtained image is visually checked, the transferability grade is determined according to the following criteria. In the evaluation, rate B or higher is in the allowable range.

The results are indicated in Table 2.

Evaluation criteria for transferability

G1: White spot does not exist in concave portion of embossed paper.

G2: There is a loss in image area of 10% or less in concave portion of embossed paper.

G3: There is a loss in image area of less than 30% in concave portion of embossed paper.

G4: There is a loss in image area of 30% or more in concave portion of embossed paper.

Evaluation of External Additive Detachability

The external additive detachability ("detachment" in Table 2) from the toner particles is evaluated by the following method and criteria. The results are indicated in Table 2.

The amount of particles remaining (hereinafter, referred to as amount of particles after dispersion) in the toner after removal of the particles by the above treatment and the amount of toner particles (hereinafter, referred to as the amount of particles before dispersion) not subjected to the treatment for removing the above particles are determined by the fluorescent X-ray method, and the values of the amount of particles before dispersion and the amount of particles after dispersion are substituted into the following expression.

The value calculated by the following expression is defined as a particle detachment rate.

Particle detachment rate (% by weight)=[(particle amount before dispersion−particle amount after dispersion)/particle amount before dispersion]×100 Expression:

Evaluation criteria for the detachability evaluation are as follows.

G1: Detachment rate is less than 30% (no problem in actual use)

G2: Detachment rate is 30% or more and less than 50% (no problem in actual use)

G3: Detachment rate is 50% or more (problems in actual use)

TABLE 2

| | | Silica particle | | | | | Evaluation | | |
|---|---|---|---|---|---|---|---|---|---|
| | ΔH2/ΔH1 | Kinds | Particle diameter (nm) | BET ($m^2/g$) | Coverage ratio (%) | Fluidity index | Low temperature fixability | Transferability | Detachment |
| Example D1 | 0.150 | D-A | 45 | 124 | 87 | 16 | G1 | G1 | G1 |
| Example D2 | 0.083 | D-A | 45 | 124 | 87 | 17 | G2 | G2 | G1 |
| Example D3 | 0.326 | D-A | 45 | 124 | 87 | 17 | G2 | G2 | G1 |
| Example D4 | 0.150 | D-B | 78 | 121 | 87 | 17 | G2 | G2 | G1 |
| Example D5 | 0.150 | D-C | 35 | 145 | 87 | 17 | G2 | G2 | G1 |
| Example D6 | 0.098 | D-D | 78 | 102 | 87 | 19 | G2 | G2 | G1 |
| Example D7 | 0.098 | D-A | 45 | 124 | 81 | 18 | G2 | G2 | G1 |
| Comparative Example F1 | 0.027 | D-A | 45 | 124 | 87 | 22 | G3 | G3 | G3 |
| Comparative Example F2 | 0.150 | D-H | 64 | 85 | 87 | 21 | G2 | G3 | G3 |

First, 100 ml of ion exchanged water and 5.5 ml of 10% by weight octylphenol ethoxylate (Triton X100 aqueous solution (produced by Acros Organics)) are added to a 200 ml glass bottle, and 5 g of the toner to be evaluated is added to the mixed solution, stirred 30 times, and allowed to stand for more than 1 hour.

Then, after stirring the above mixed solution 20 times, using an ultrasonic homogenizer (manufactured by SONICS & MATERIALS Co., Ltd., product name homogenizer, model VCX750, CV33), a dial is set at an output of 30%, and ultrasonic energy is applied for 1 minute under the following conditions.

Vibration time: 60 seconds continuous

Amplitude: Set to 20 W (30%)

Vibration start temperature: 40±1.5° C.

Distance between ultrasonic transducer and bottom of container: 10 mm

Next, the mixed solution to which ultrasonic energy is applied is suction filtered using a filter paper [trade name: qualitative filter paper (No. 2, 110 mm), manufactured by Advantech Toyo Co., Ltd.], and washed again with ion exchanged water twice, free particles are removed by filtration, and then the toner is dried.

From the results in Table 2, it can be seen that in this example, the detachment of the external additive is prevented as compared with the comparative examples. In addition, in this example, it can be seen that a decrease in the transferability in a high temperature and high humidity environment is prevented as compared with the comparative example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles comprising an amorphous resin and a crystalline polyester resin comprising a polycondensate of a linear dicarboxylic acid and a linear dialcohol having 2 to 12 carbon atoms; and an external additive comprising silica particles having a BET specific surface area of 100 $m^2/g$ or more, the electrostatic charge image developing toner satisfying the expression: $0.05 \leq \Delta H2/\Delta H1 \leq 0.95$, wherein $\Delta H1$ (mW/g) is an endothermic energy amount based on an endothermic peak derived from the crystalline polyester resin in a first temperature increase process in differential scanning calorimetry according to ASTM D3418-8 (2008), and $\Delta H2$ (mW/g) is an endothermic energy amount based on an endothermic peak derived from the crystalline polyester resin in a second temperature increase process in differential scanning calorimetry according to ASTM D3418-8 (2008).

2. The electrostatic charge image developing toner according to claim 1, which satisfies the expression: $0.35 < \Delta H2/\Delta H1 \leq 0.95$.

3. The electrostatic charge image developing toner according to claim 2, which satisfies the expression: $0.45 < \Delta H2/\Delta H1 \leq 0.80$.

4. The electrostatic charge image developing toner according to claim 1, which satisfies the expression: $0.05 \leq \Delta H2/\Delta H1 \leq 0.35$.

5. The electrostatic charge image developing toner according to claim 4, which satisfies the expression: $0.15 \leq \Delta H2/\Delta H1 \leq 0.25$.

6. The electrostatic charge image developing toner according to claim 1, wherein the silica particles have an average primary particle diameter of 20 nm to 90 nm.

7. The electrostatic charge image developing toner according to claim 1, wherein the silica particles are sol-gel silica particles.

8. The electrostatic charge image developing toner according to claim 1, wherein the external additive provides a coverage ratio of 80% or more.

9. The electrostatic charge image developing toner according to claim 1, which has a flowability index of 20 or less after stored for 24 hours in an environment at a temperature of 50° C. and a humidity of 50%.

10. The electrostatic charge image developing toner according to claim 1, further comprising a low molecular siloxane having a molecular weight of 200 to 600 and consisting essentially of siloxane bonds and alkyl groups.

11. The electrostatic charge image developing toner according to claim 10, wherein the low molecular siloxane has a tetrakis structure.

12. The electrostatic charge image developing toner according to claim 10, which has a total content of the low molecular siloxane of 0.01 ppm to 10 ppm based on the weight of the electrostatic charge image developing toner.

13. The electrostatic charge image developing toner according to claim 1, wherein the crystalline polyester resin and the amorphous resin make a difference ($\Delta SP$ value) of 0.1 to 1.2 in solubility parameter (SP value).

14. An electrostatic charge image developer comprising the electrostatic charge image developing toner according to claim 1.

15. A process cartridge comprising:

a developing unit that contains the electrostatic charge image developer according to claim 14 and develops an electrostatic charge image formed on a surface of an image holding member with the electrostatic charge image developer to form a toner image, the process cartridge being attachable to and detachable from an image forming apparatus.

16. An image forming apparatus comprising:

an image holding member;

a charging unit that charges a surface of the image holding member;

an electrostatic charge image forming unit that forms an electrostatic charge image on the charged surface of the image holding member;

a developing unit that contains the electrostatic charge image developer according to claim 14 and develops the electrostatic charge image formed on the surface of the image holding member with the electrostatic charge image developer to form a toner image;

a transfer unit that transfers the toner image formed on the surface of the image holding member onto a surface of a recording medium; and a fixing unit that fixes the toner image transferred onto the surface of the recording medium.

17. An image forming method comprising:

charging a surface of an image holding member;

forming an electrostatic charge image on a surface of the charged image holding member;

developing the electrostatic charge image formed on the surface of the image holding member with the electrostatic charge image developer according to claim 14 to form a toner image;

transferring the toner image formed on the surface of the image holding member onto a surface of a recording medium; and fixing the toner image transferred onto the surface of the recording medium.

18. A toner cartridge comprising a container that contains the electrostatic charge image developing toner according to claim 1, the toner cartridge being attachable to and detachable from an image forming apparatus.

19. The electrostatic charge image developing toner according to claim 1, wherein a total content of the amorphous resin and the crystalline polyester resin is 80% by weight or more all resins contained in the toner particles;

a content of all resins in the toner particles is from 40% by weight to 95% by weight with respect to an entire weight of the toner particles;

a content of the crystalline polyester resin with respect to the total content of the amorphous resin and the crystalline polyester resin is 2% by weight to 40% by weight; and a content of the silica particles in an entire external additive of the toner is 10% by weight or more.

20. The electrostatic charge image developing toner according to claim 1, wherein a total content of the amorphous resin and the crystalline polyester resin is 95% by weight or more all resins contained in the toner particles;

a content of all resins in the toner particles is from 60% by weight to 85% by weight with respect to an entire weight of the toner particles;

a content of the crystalline polyester resin with respect to the total content of the amorphous resin and the crystalline polyester resin is 4% by weight to 15% by weight; and a content of the silica particles in an entire external additive of the toner is from 25% by weight to 60% by weight.

* * * * *